US009849680B2

(12) United States Patent
Ogawa

(10) Patent No.: US 9,849,680 B2
(45) Date of Patent: Dec. 26, 2017

(54) LIQUID DISCHARGE APPARATUS

(71) Applicant: Brother Kogyo Kabushiki Kaisha, Nagoya-shi, Aichi-ken (JP)

(72) Inventor: Mikio Ogawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/424,139

(22) Filed: Feb. 3, 2017

(65) Prior Publication Data

US 2017/0225467 A1 Aug. 10, 2017

(30) Foreign Application Priority Data

Feb. 5, 2016 (JP) ..... 2016-021368

(51) Int. Cl.
*B41J 2/165* (2006.01)

(52) U.S. Cl.
CPC ..... *B41J 2/16505* (2013.01); *B41J 2/16508* (2013.01); *B41J 2/16511* (2013.01)

(58) Field of Classification Search
CPC . B41J 2/16505; B41J 2/16511; B41J 2/16508
See application file for complete search history.

(56) References Cited

U.S. PATENT DOCUMENTS

2007/0019029 A1* 1/2007 Hiruma ..... B41J 2/16511 347/29

FOREIGN PATENT DOCUMENTS

| | | | |
|---|---|---|---|
| JP | 3728963 | B2 | 12/2005 |
| JP | 2009-208271 | A | 9/2009 |
| JP | 2011-136436 | A | 7/2011 |

* cited by examiner

*Primary Examiner* — Geoffrey Mruk
(74) *Attorney, Agent, or Firm* — Banner & Witcoff, Ltd.

(57) ABSTRACT

There is provided a liquid discharge apparatus including a liquid discharge head, a carriage, a cap, and a cap moving mechanism configured to locate the cap in a capping position and in an uncapping position. The cap moving mechanism has a moving member configured to move integrally with the cap in a first direction, a carriage locker, and a restraint portion configured to restrain the moving member from rotating about an axis orthogonal to the first direction. The restraint portion restrains the moving member from rotating such that when the cap arrives in the uncapping position, the rotating range of the carriage locker does not overlap with the carriage in a scanning direction.

15 Claims, 14 Drawing Sheets

LIQUID DISCHARGE APPARATUS

CROSS REFERENCE TO RELATED APPLICATION

The present application claims priority from Japanese Patent Application No. 2016-021368, filed on Feb. 5, 2016, the disclosure of which is incorporated herein by reference in its entirety.

BACKGROUND

Field of the Invention

The present invention relates to liquid discharge apparatuses for discharging liquid from nozzles.

Description of the Related Art

As an example of liquid discharge apparatuses for discharging liquid from nozzles, conventionally, there are publicly known image recording apparatuses for discharging inks from nozzles to carry out recording. Such a publicly known image recording apparatus can move a cap for covering the nozzles of a recording head between a position in contact with the recording head to cover the nozzles, and a position separate from the recording head. Further, when the recording is not carried out, the cap is positioned to cover the nozzles, and a carriage locker (a projection) moving integrally with the cap is arranged in such a position as able to overlap with the carriage in a scanning direction. By virtue of this, the carriage locker restrains the carriage from moving in the scanning direction. Then, when an instruction is issued to start a recoding, then the cap is moved to the position separate from the recording head and the carriage locker is also moved along with the cap. By virtue of this, the carriage locker no longer overlaps with the carriage in the scanning direction, so that the carriage is released from the restraint of moving in the scanning direction.

SUMMARY

Here, in the image recording apparatus mentioned above, the carriage locker is configured to be movable in an inclined manner. Therefore, when the cap is moved from the position covering the nozzles to the position being separate from the recording head, the carriage locker may incline. When the carriage locker does not incline, then at the time of moving the cap from the position covering the nozzles through a predetermined distance, the carriage locker no longer overlaps with the carriage in the scanning direction. That is, the above restraint is released. However, according to the inclination manner of the carriage locker, even at the time of moving the cap through the predetermined distance, the carriage locker still overlaps with the carriage in the scanning direction. In such a case, the above restraint is not released. Therefore, it is necessary to assume the inclination of the carriage locker, and move the cap through a longer distance than the predetermined distance before starting to move the carriage. As a result, a longer time is inevitably needed from the instruction of starting a recording to the performance of the recording.

It is an object of the present teaching to provide a liquid discharge apparatus capable of suppressing the inclination of the carriage locker for restraining the carriage from moving when the cap is moved.

According to an aspect of the present teaching, there is provided a liquid discharge apparatus including:

a liquid discharge head including a nozzle surface having a nozzle;

a carriage mounting the liquid discharge head thereon and being movable in a first direction;

a cap configured to contact with the liquid discharge head to cover the nozzle; and a cap moving mechanism configured to move the cap in a second direction intersecting the nozzle surface to locate the cap in a capping position in contact with the liquid discharge head to cover the nozzle, and in an uncapping position separated away from the liquid discharge head, the cap moving mechanism including:

a moving member holding the cap to be rotatable about a first rotational axis orthogonal to the nozzle surface and configured to move integrally with the cap in the second direction;

a carriage locker provided on the moving member to rotate integrally with the moving member and configured to restrain the carriage from moving in the first direction, the carriage locker overlapping with the carriage in the first direction with the cap in the capping position, and not overlapping with the carriage in the first direction with the cap in the uncapping position; and a restraint portion configured to restrain the moving member from rotating about a second rotational axis orthogonal to the second direction;

wherein the restraint portion restrains the moving member from rotating such that when the cap arrives in the uncapping position, a rotating range of the carriage locker rotated with the moving member does not overlap with the carriage in the first direction.

The restraint portion restrains the moving member from rotation such that the carriage locker may not overlap with the carriage in the first direction corresponding to the scanning direction even when the carriage locker rotates along with the moving member to incline. Therefore, it is not necessary to assume the inclination of the carriage locker, and the carriage locker does not restrain the carriage from moving even when the carriage starts to move at the point of the carriage having arrived in the uncapping position. As a result, from the state of the plurality of nozzles being covered by the cap, it is possible to separate the cap from the nozzle, thereby shortening the time of switching the carriage to the movable state.

BRIEF DESCRIPTION OF THE DRAWINGS

FIGS. 13A to 13C schematically depict a positional relation between respective members of the capping unit, wherein FIG. 13A depicts an ordinary state, FIG. 13B depicts a state of a carriage and the like moved by an external force, and FIG. 13C depicts a state after FIG. 13B; and FIGS. 14A to 14D schematically depict a positional relation between the respective members of the capping unit according to a comparative example, wherein FIG. 14A depicts an ordinary state, FIG. 14B depicts a state of the carriage and the like moved by an external force. FIG. 14C depicts a state after FIG. 14B, and FIG. 14D depicts a state after FIG. 14C.

DESCRIPTION OF THE EMBODIMENT

Hereinbelow, an embodiment of the present teaching will be explained.

(A Schematic Configuration of a Printer)

Figure 1:
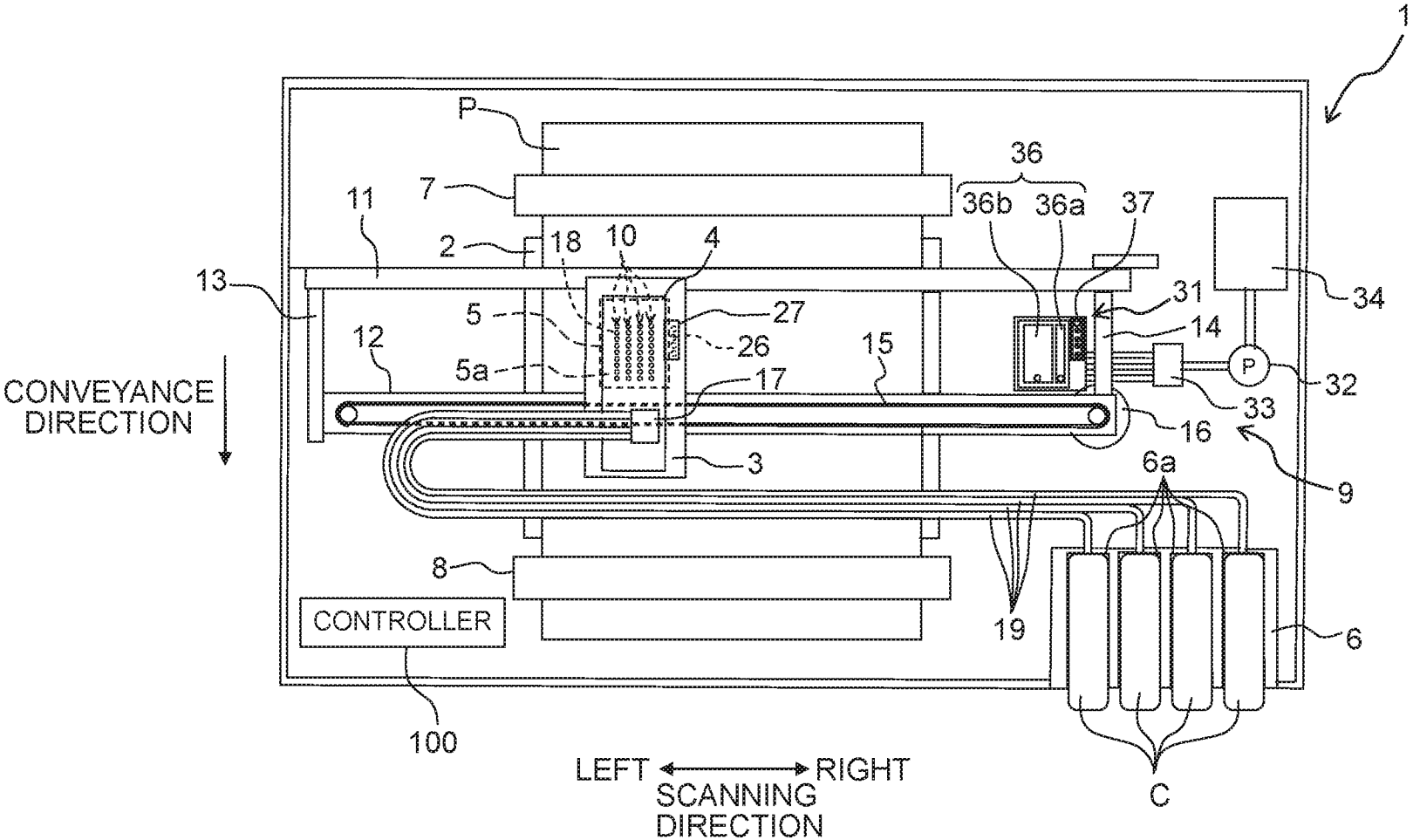
FIG. 1 is a schematic configuration diagram of a printer according to an embodiment of the present teaching.

As depicted in FIG. 1, a printer 1 includes a platen 2, a carriage 3, a sub-tank 4, an ink jet head 5, a cartridge holder 6, a conveyance roller 7, a paper discharge roller 8, a maintenance unit 9, and the like. Further, a controller 100 controls the operation of the printer 1.

The platen 2 supports recording paper P which is a recording medium conveyed by the conveyance roller 7 and the paper discharge roller 8. Further, two guide rails 11 and 12 are provided above the platen 2 to extend in parallel with a scanning direction. The two guide rails 11 and 12 are supported, respectively, by frames 13 and 14 at two opposite ends in the scanning direction. The carriage 3 is configured to be movable in the scanning direction along the two guide rails 11 and 12. The carriage 3 is connected to an endless drive belt 15, and the drive belt 15 is driven by a carriage motor 16. Thus, the carriage 3 moves in the scanning direction. Further, the following explanation will be made with the right side and the left side in the scanning direction defined as depicted in FIG. 1.

Figure 2:
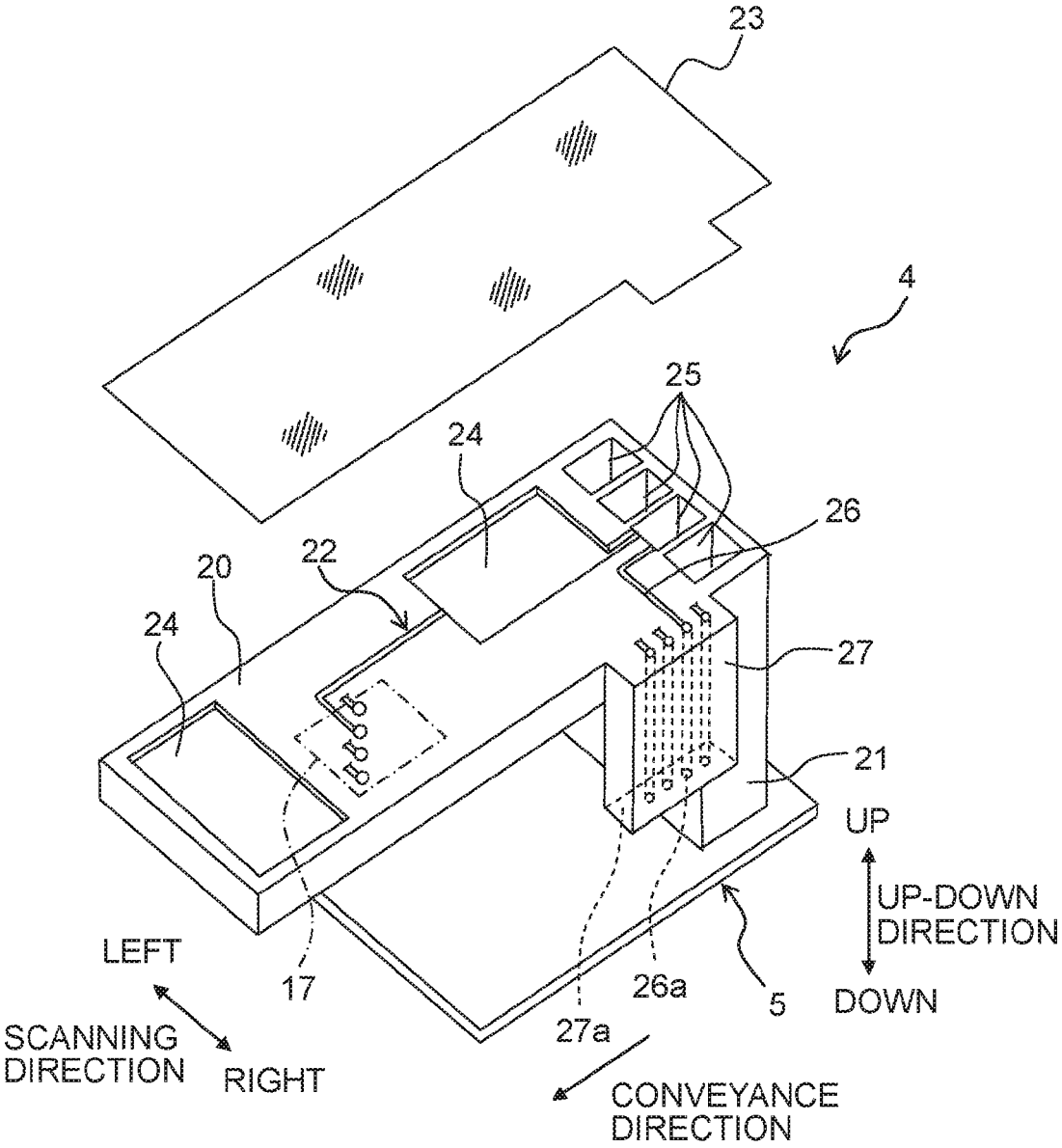
FIG. 2 is a perspective view depicting a schematic configuration of a sub-tank and an ink jet head.

The sub-tank 4 is mounted on the carriage 3. As depicted in FIGS. 1 and 2, a tube joint 17 is provided on the upper surface of the sub-tank 4. The tube joint 17 is connected to the cartridge holder 6 via four tubes 19. Further, in order to discharge air bubbles mixed into liquid channels in the sub-tank 4, an air release unit 27 is provided on the right lateral surface of the sub-tank 4. A detailed explanation will be made later on a configuration of the sub-tank 4 and the air release unit 27.

The cartridge holder 6 includes four cartridge installation portions 6*a* aligning in the scanning direction. Each of the cartridge installation portions 6*a* is provided with an ink cartridge C. Pigment inks of black, yellow, cyan and magenta are retained in order in the ink cartridges C installed in the cartridge installation portions 6*a* from the right side to the left side in FIG. 1. Then, via the four tubes 19, the sub-tank 4 is supplied with the above four color inks retained in the four ink cartridges C installed in the four cartridge installation portions 6*a*.

The ink jet head 5 is fitted under the sub-tank 4. The ink jet head 5 has ink channels including a plurality of nozzles 18 formed in an ink jet surface 5*a* which is the lower surface of the ink jet head 5. The ink jet head 5 is supplied with the inks from the sub-tank 4 and jets the inks from the plurality of nozzles 18. Four nozzle rows 10 are arranged in the ink jet head 5. Each of the nozzle rows has a plurality of the nozzles 18 aligned in a conveyance direction orthogonal to the scanning direction. The four nozzle rows 10 align in the scanning direction to jet the inks of the different colors according to each of the nozzle rows 10. In particular, the four nozzle rows 10 jet the inks of magenta, cyan, yellow and black in order from the left side to the right side in the scanning direction.

The maintenance unit 9 is arranged in a maintenance position on the right side of the platen 2 in the scanning direction. The maintenance unit 9 serves to carry out a maintenance operation to maintain and restore the ink jet head 5 for its jet function. A detailed configuration of the maintenance unit 9 will be explained later on.

(The Sub-Tank)

As depicted in FIG. 2, the sub-tank 4 has a main body 20 extending along a horizontal plane, and a connecting part 21 extending vertically downward from the end of the main body 20 on the upstream side in the conveyance direction. The sub-tank 4 is formed with four ink supply channels 22 through which the four color inks flow to correspond to the four nozzle rows 10. Further, in order to simplify the drawing of FIG. 2, only one of the four ink supply channels 22 is illustrated entirely whereas the other three ink supply channels 22 are illustrated as partially omitted.

Each of the ink supply channels 22 includes a damper chamber 24 formed in the main body 20 and a communication channel 25 formed in the connecting part 21. Flexible films 23 are attached respectively to the upper and lower surfaces of the main body 20 to cover the channel including the damper chamber 24 formed in the main body 20. The damper chamber 24 has a more flattened cross section than the channel part of the ink supply channel 22 connected on the upstream side and the downstream side of the damper chamber 24. The damper chamber 24 absorbs a pressure variation of the ink flowing through the ink supply channel 22 by way of deformation of the flexible films 23. The connecting part 21 of the sub-tank 4 is connected to the ink jet head 5. The ink flowing through the ink supply channel 22 is supplied to the ink jet head 5 from the communication channel 25 formed in the connecting part 21.

Further, as depicted in FIG. 2, the main body 20 is formed with four air release channels 26 connected respectively to the four ink supply channels 22. Further, in order to simplify the drawing, FIG. 2 only illustrates one of the four air release channels 26 entirely whereas the other three air release channels 26 are illustrated as partially omitted.

Each of the air release channels 26 extends to the air release unit 27 provided on the right lateral surface of the sub-tank 4. Further, the channel parts positioned inside the air release unit 27 of the air release channels 26 extend in a vertical direction. The lower ends of the channel parts of the air release channels 26 serve as opening portions 26*a*. By virtue of this, in an air release surface 27*a*, that is, the lower surface of the air release unit 27, the four opening portions 26*a* corresponding to the four air release channels 26 align in one row in the conveyance direction. Further, an unshown valve is provided in the vertically extending part of each of the air release channels 26 for opening and closing the air release channel 26. Here, the vertical direction refers to the direction of gravity action.

(The Maintenance Unit)

The maintenance unit 9 includes, as depicted in FIG. 1, a capping unit 31, a suction pump 32, a switch device 33, and a waste liquid tank 34.

(The Capping Unit)

As depicted in FIGS. 3 and 4, FIGS. 5A and 5B, and FIGS. 6A and 6B, the capping unit 31 includes a nozzle cap 36, an air release cap 37, a cap holder 50, a cap lift holder 60, a cap lift base 70, a base member 80, a slide cam 90, and the like.

The nozzle cap 36 is formed of, for example, a rubber material. As depicted in FIGS. 1, 3 and 4, and FIGS. 5A and 5B, The nozzle cap 36 has a cap portion 36*a* and another cap portion 36*b* arranged on the left side of the cap portion 36*a*. When the carriage 3 moves to the maintenance position, then the cap portion 36*a* faces the rightmost nozzle row 10 while the cap portion 36*b* faces the three nozzle rows 10 on the left. Further, suction ports 36*c* and 36*d* are provided respectively in upstream ends of the cap portions 36*a* and 36*b* in the conveyance direction. The cap portions 36*a* and 36*b* are connected respectively with the switch device 33 via tubes at the suction ports 36*c* and 36*d*.

The air release cap 37 is formed of, for example, a rubber material. As depicted in FIGS. 1, 3 and 4, and FIGS. 5A and 5B, the air release cap 37 is arranged on the right side of the nozzle cap 36. When the carriage 3 moves to the maintenance position, then the air release cap 37 faces the air release surface 27*a* of the air release unit 27. Further, a suction port 37*a* is provided in the upstream end of the air release cap 37 in the conveyance direction. The air release cap 37 is connected with the switch device 33 via a tube at the suction port 37*a*. Further, the air release cap 37 is shorter than the nozzle cap 36 in the conveyance direction. Then, the nozzle cap 36 and the air release cap 37 have approximately the same position at the upstream ends in the conveyance direction.

(The Cap Holder)

As depicted in FIGS. 3 and 4, FIGS. 5A and 5B, and FIGS. 7A and 7B, the cap holder 50 is approximately rectangular in planar view, and is formed into a concave shape opening at the upper surface. The nozzle cap 36 is contained in the concave cap holder 50 to be held by the cap holder 50. To explain in more detail, the nozzle cap 36 is placed on an upper surface 51*a* of a bottom wall portion 51 forming a lower portion of the concave cap holder 50. Further, the nozzle cap 36 is enclosed throughout the circumference by such an edge wall portion 52 of the bottom wall portion 51 as projecting upward from the edge on the outer side of the nozzle cap 36. Further, the edge wall portion 52 is not limited to completely enclosing the nozzle cap 36 throughout the circumference. For example, the edge wall portion 52 may be partially absent to enclose part of the nozzle cap 36. Much the same is true on an edge wall portion 62 of the cap lift holder 60 and an edge wall portion 102 of the cap lift base 70 which will both be described later on. Further, the upper end of an inner wall surface 52*a* of the edge wall portion 52 serves as a taper portion 52*al* in such a taper shape that the farther toward the lower side, the farther toward the inner side. That is, the upper end of the inner wall surface 52*a* is formed of the taper portion 52*al* in such a taper shape that the closer to the nozzle cap 36, the farther toward the inner side.

Further, the bottom wall portion 51 has such a right end in the scanning direction on the downstream side in the conveyance direction as to extend to the right side of the other parts of the bottom wall portion 51. Then, that end of the bottom wall portion 51 is positioned on the right side of the nozzle cap 36 and on the downstream side of the air release cap 37. Then, in this part of the bottom wall portion 51, a discharge port 54 is formed for discharging the inks spilt into the cap holder 50 from the nozzle cap 36. The discharge port 54 is arranged at such a position of the cap holder 50. By virtue of this, a border line 55 between the bottom wall portion 51 and the edge wall portion 52 is connected directly with a wall surface 54*a* of the discharge port 54 without mediating a part on the inner side of the border line 55 of the upper surface 51*a* of the bottom wall portion 51, or a part above the border line 55 of the wall surface 52*a* of the edge wall portion 52.

Further, a cylindrical portion 53 is provided in such a part of the bottom wall portion 51 as at the lower surface overlapping vertically with the discharge port 54. The cylindrical portion 53 is formed into an approximately rectangular cylinder extending downward to the bottom wall portion 51 such that its inner space 53*a* is connected with the discharge port 54. Further, the right end of the cylindrical portion 53 serves as a projection 53*b* projecting downward below the other parts of the cylindrical portion 53.

Further, three projections 56*a* are provided to align in the conveyance direction at the downstream end of the edge wall portion 52 in the conveyance direction. Further, three projections 56*b* are provided to align in the conveyance direction at the downstream end of the edge wall portion 52 in the conveyance direction.

(The Cap Lift Holder)

Figure 3:
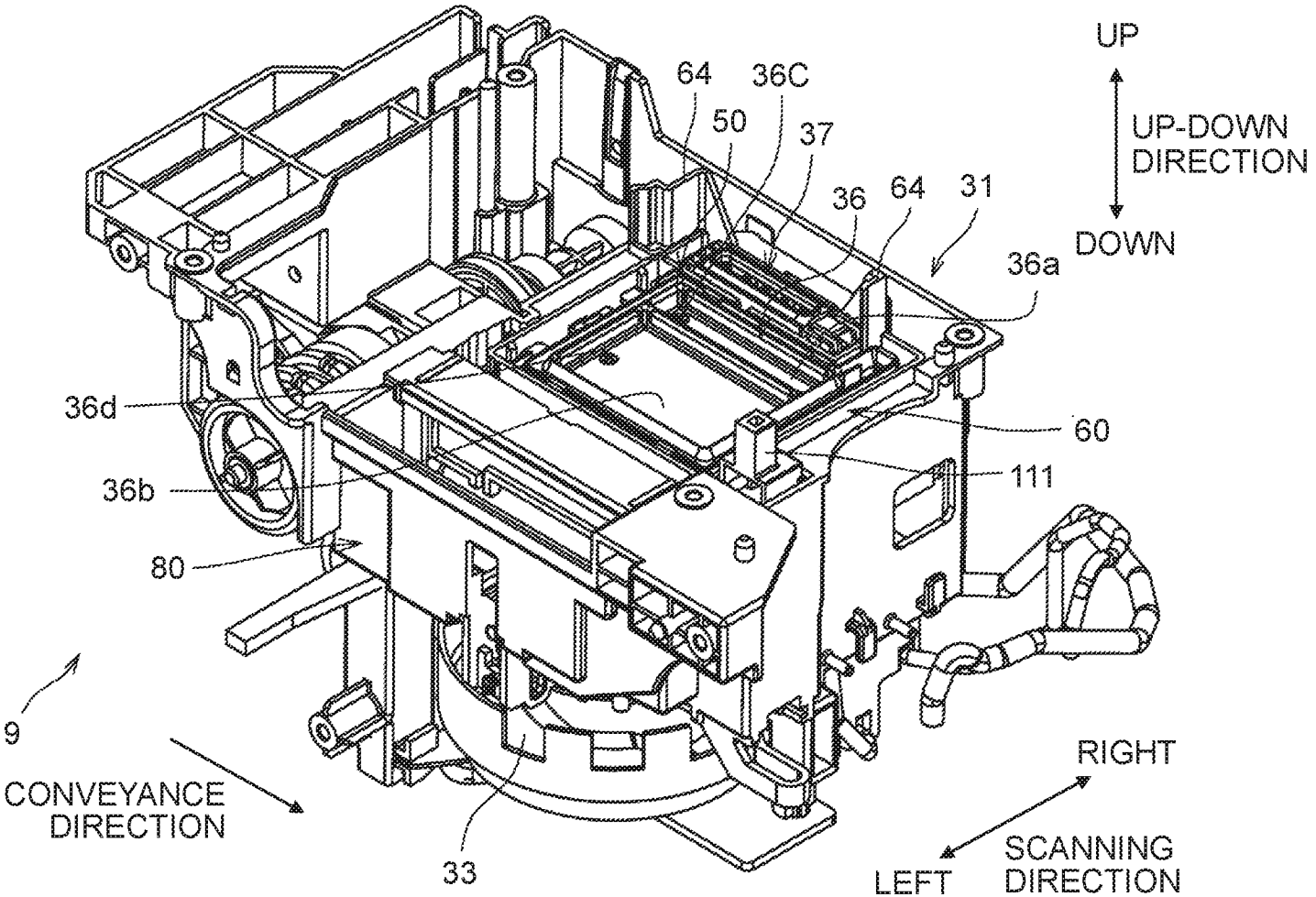
FIG. 3 is a perspective view of a capping unit.
Figure 4:
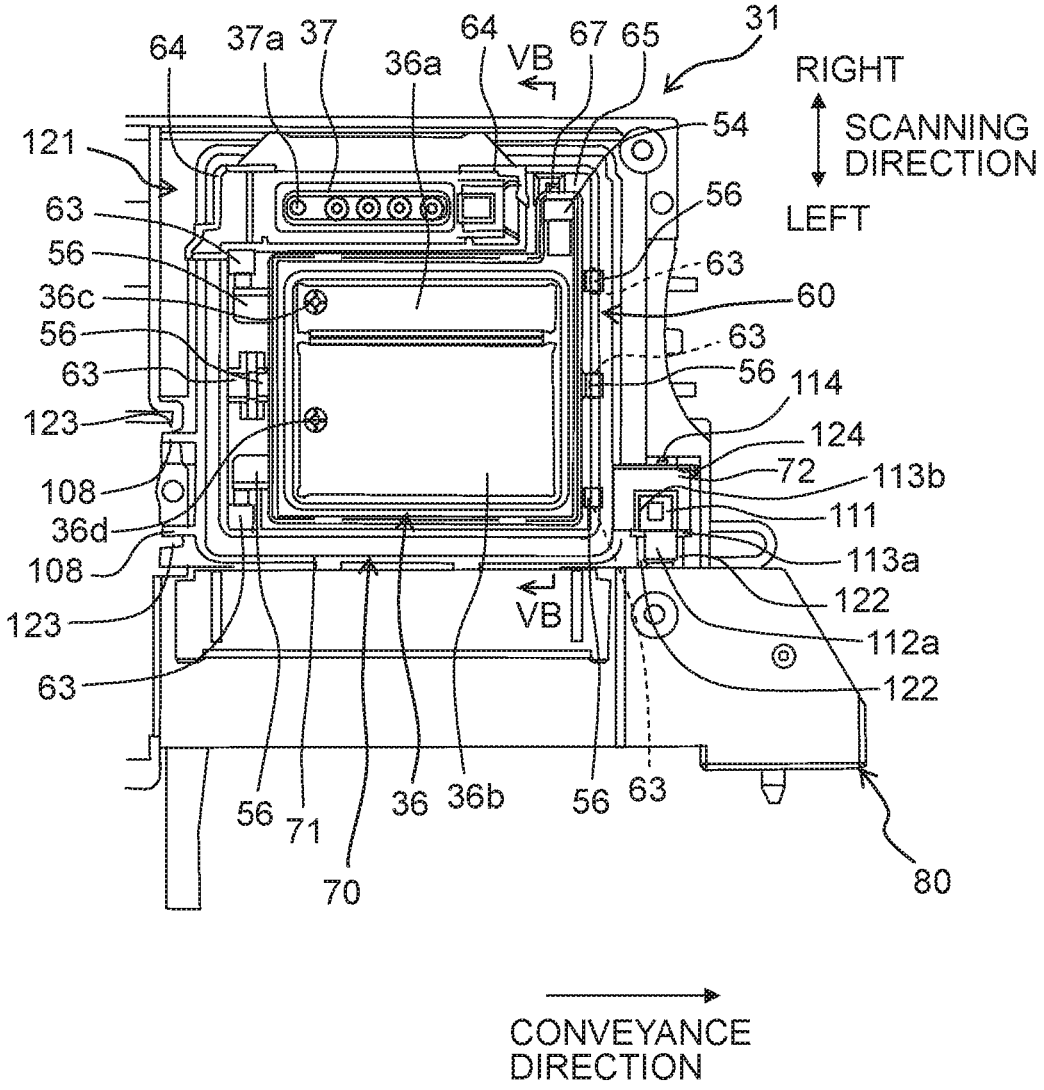
FIG. 4 is a plan view of a peripheral part of a nozzle cap of the capping unit.
Figure 5A:
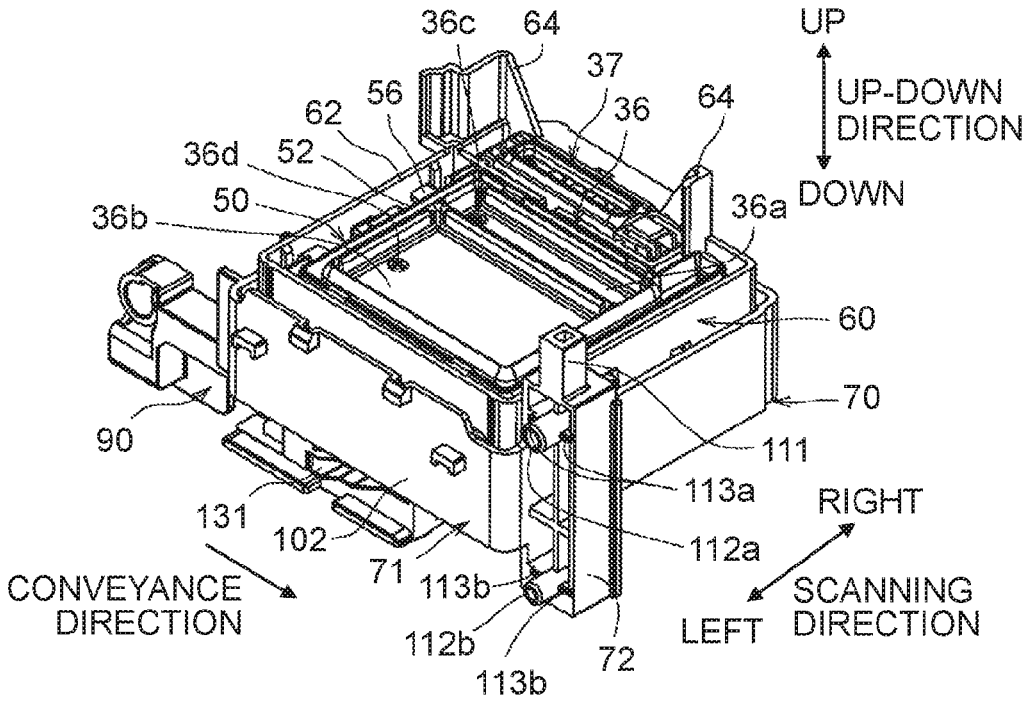
FIG. 5A is a perspective view of extracting a part of the capping unit, corresponding to FIG. 3.
Figure 5B:
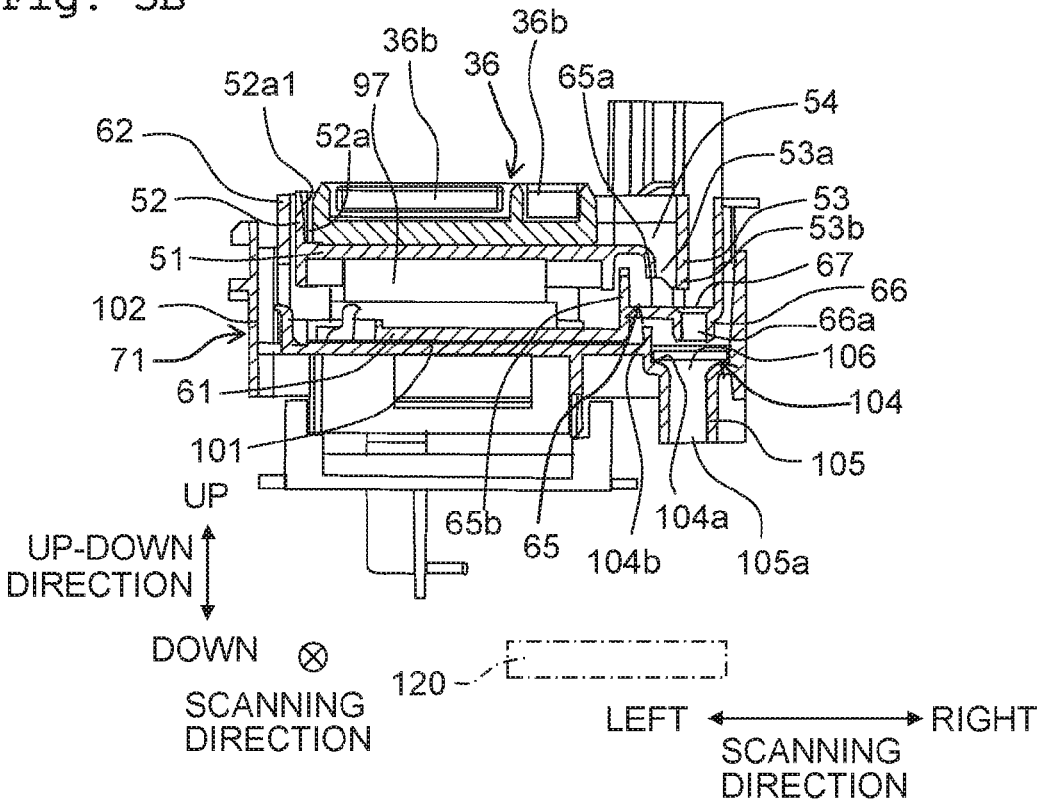
FIG. 5B is a cross-sectional view taken along the line VB-VB of FIG. 4, excluding a base member.
Figure 6A:
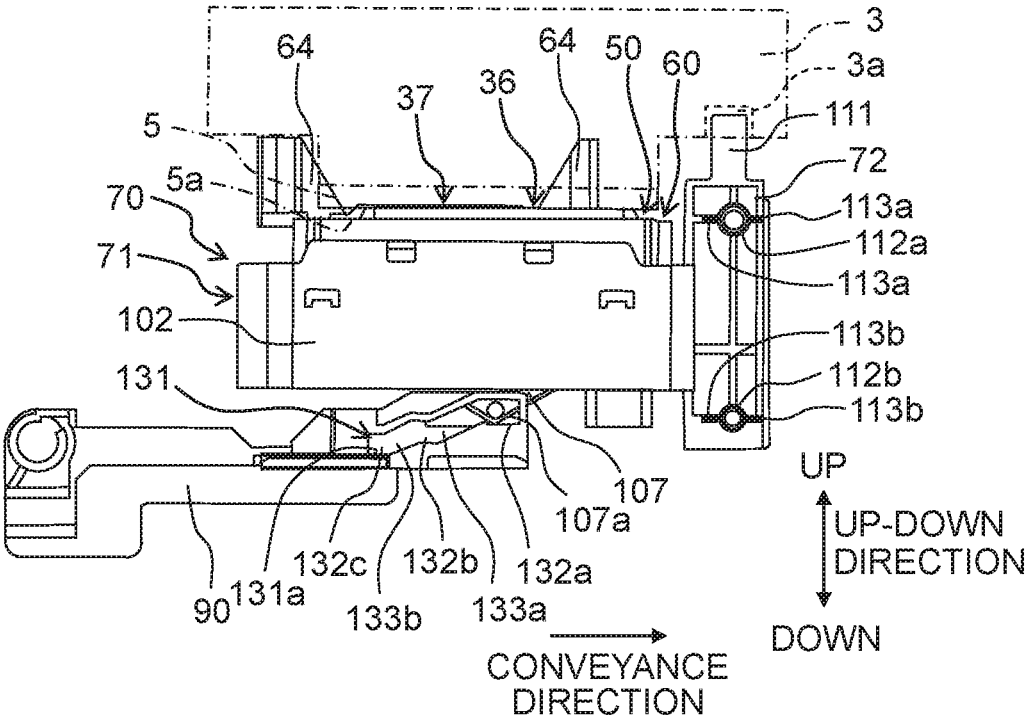
FIG. 6A is a lateral view of observing FIG. 5A from the left side.
Figure 6B:
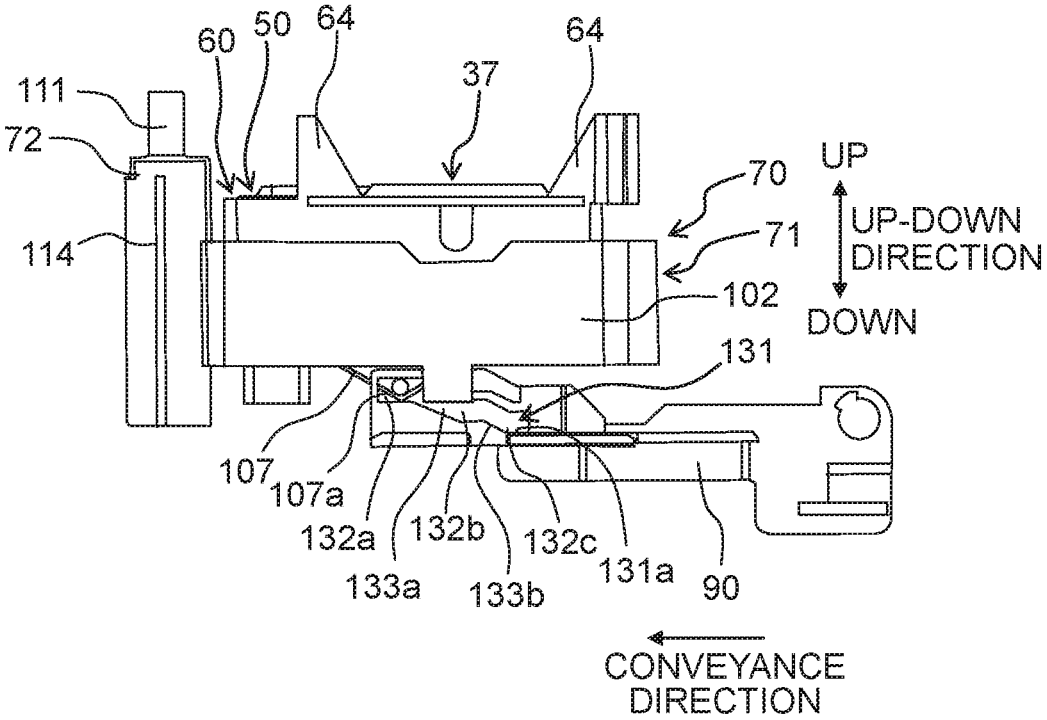
FIG. 6B is a lateral view of observing FIG. 5A from the right side.
Figure 7A:
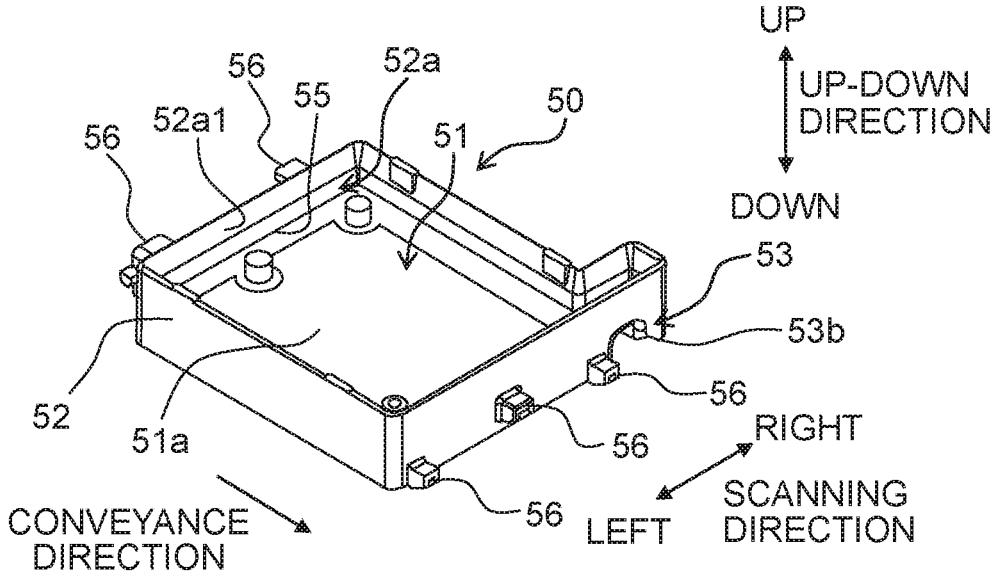
FIG. 7A is a perspective view of a cap holder, corresponding to FIG. 3.
Figure 7B:
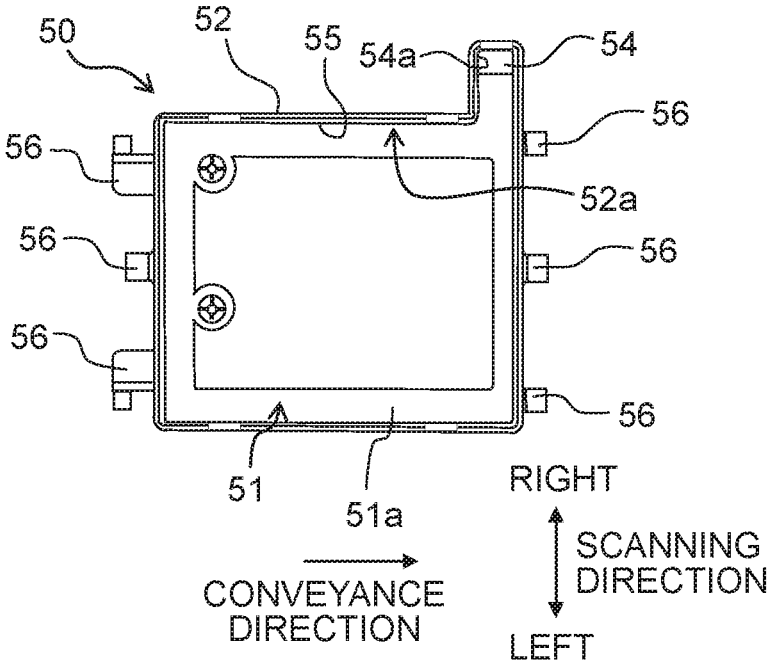
FIG. 7B is a plan view of the cap holder.
Figure 8A:
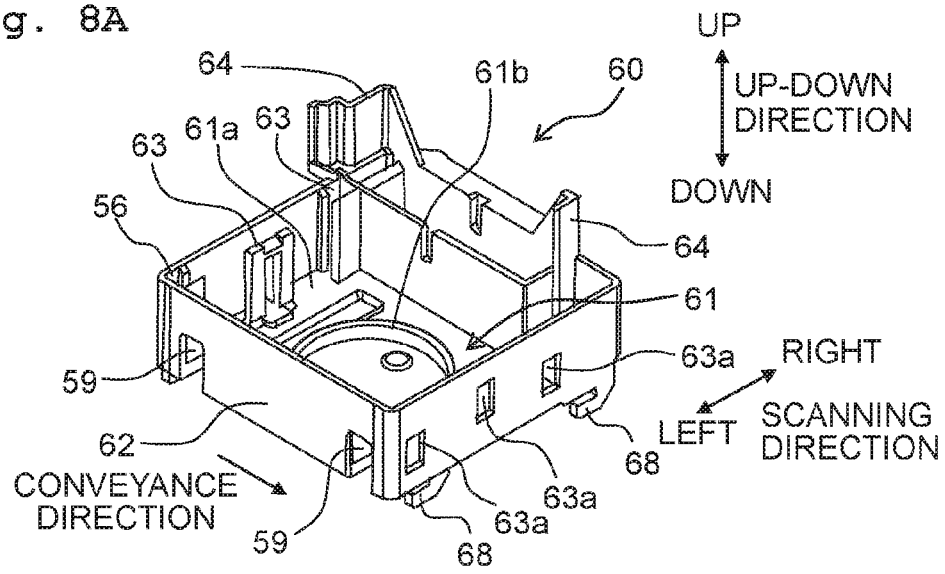
FIG. 8A is a perspective view of a cap lift holder, corresponding to FIG. 3.
Figure 8B:
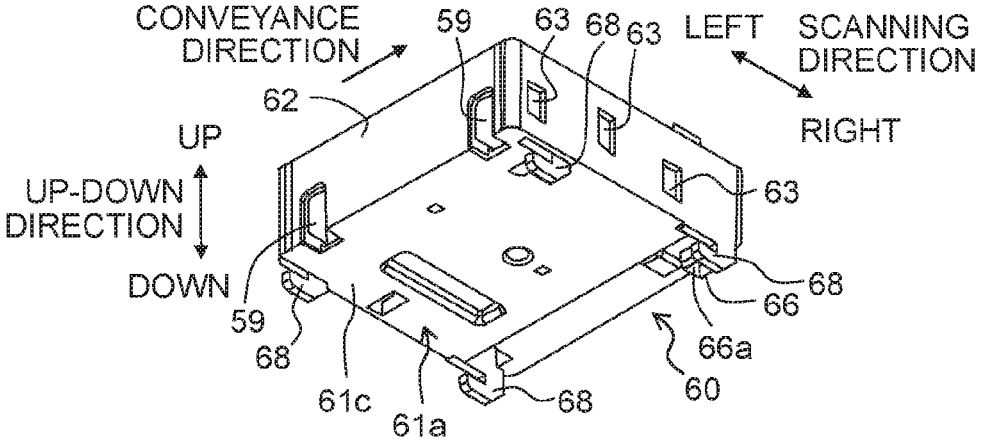
FIG. 8B is a perspective view of observing the cap lift holder from another direction than that of FIG. 8A.
Figure 8C:
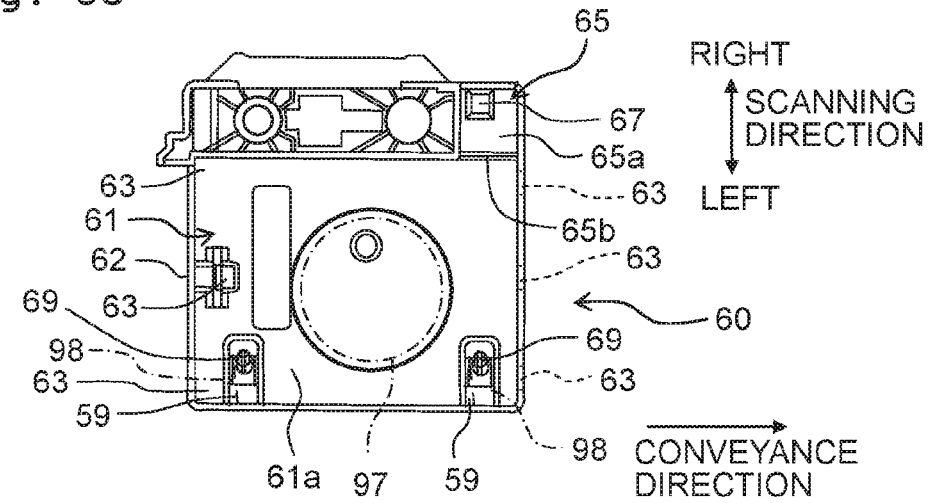
FIG. 8C is a plan view of the cap lift holder.
Figure 9A:
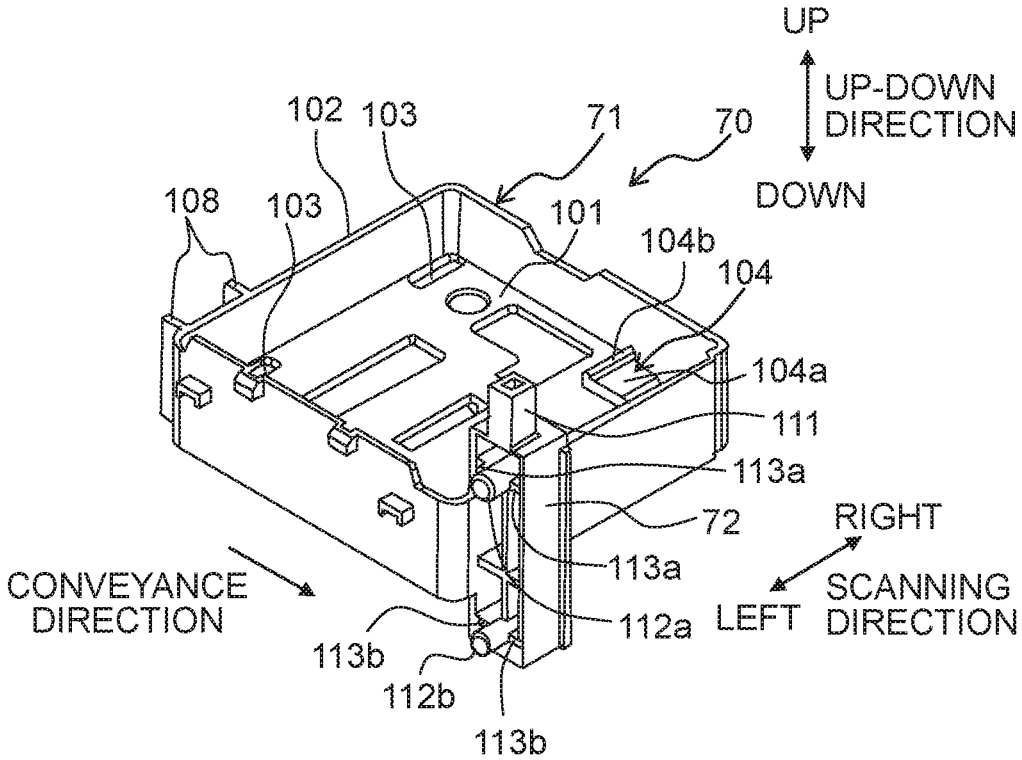
FIG. 9A is a perspective view of a cap lift base, corresponding to FIG. 3.
Figure 9B:
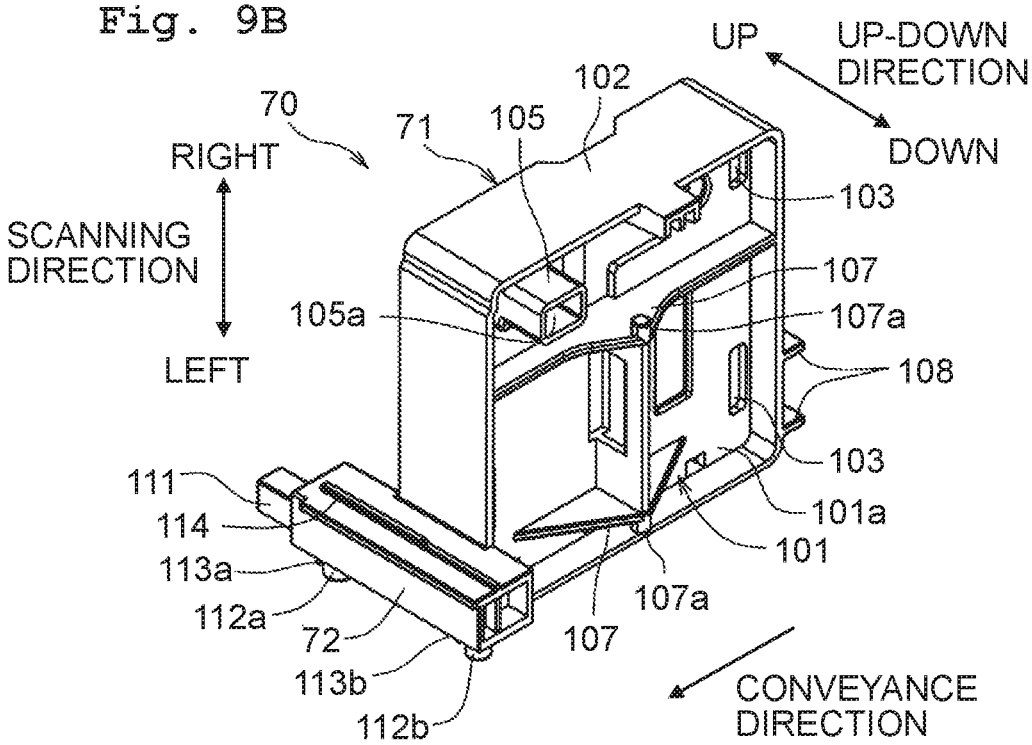
FIG. 9B is a perspective view of observing the cap lift base from another direction than that of FIG. 9A.
Figure 10A:
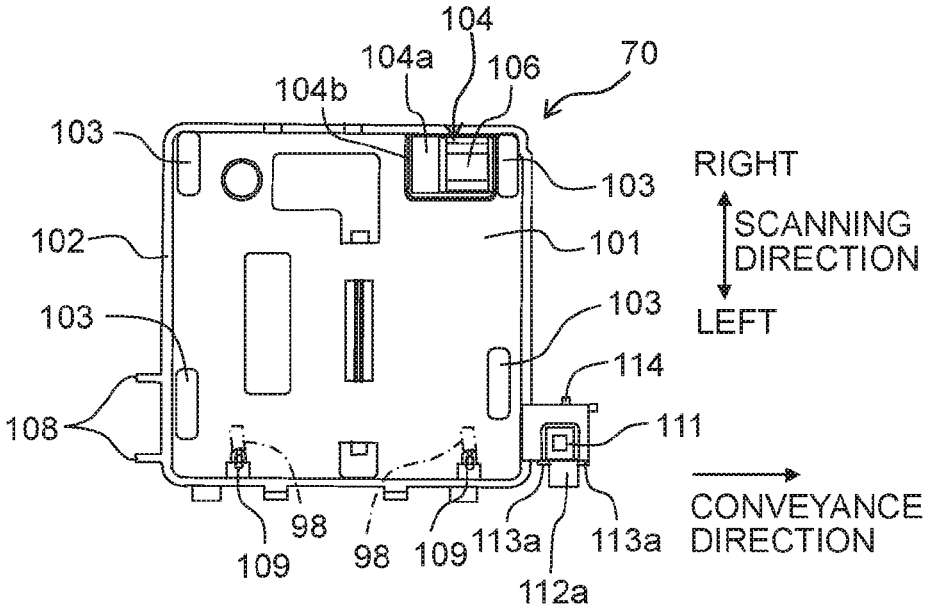
FIG. 10A is a plan view of the cap lift base.
Figure 10B:
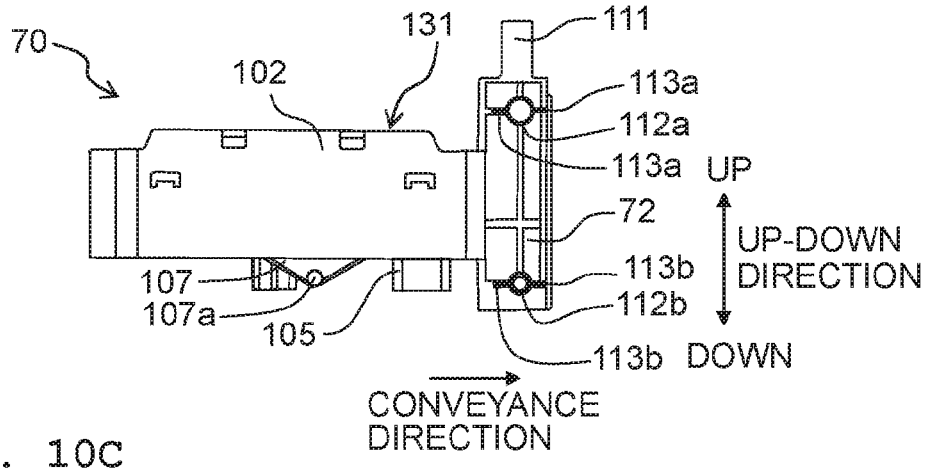
FIG. 10B is a lateral view of observing the cap lift base from the left side.
Figure 10C:
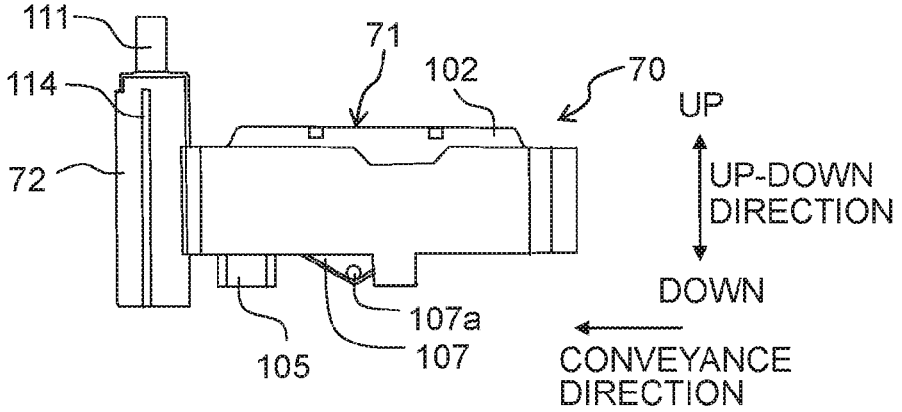
FIG. 10C is a lateral view of observing the cap lift base from the right side.
Figure 11A:
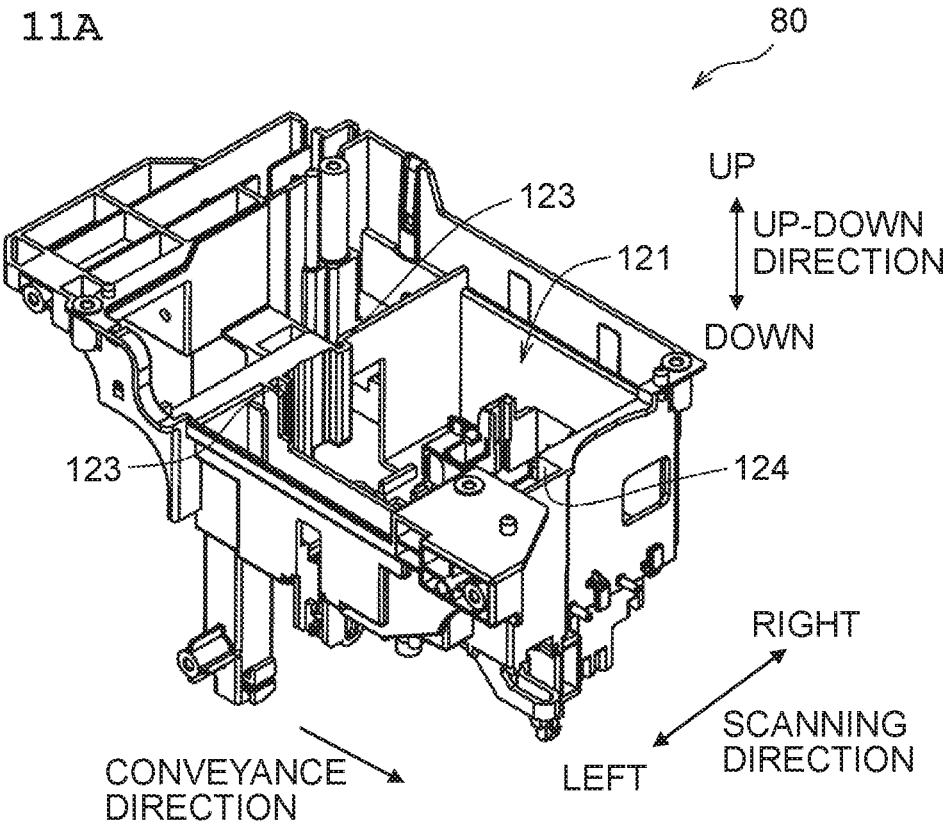
FIG. 11A is a perspective view of the base member, corresponding to FIG. 3.
Figure 11B:
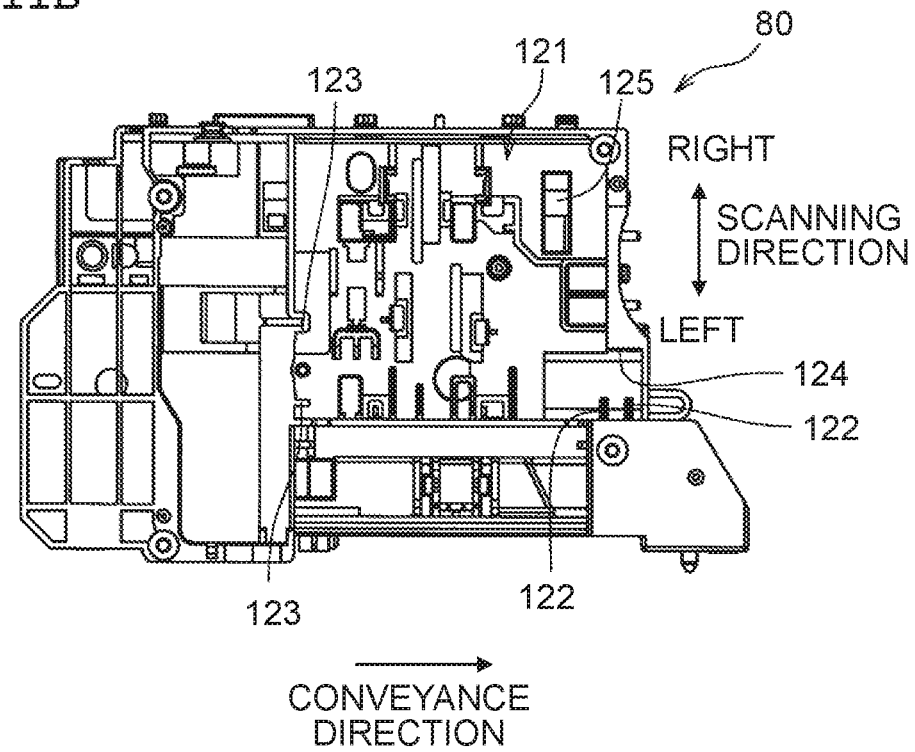
FIG. 11B is a perspective view of observing the base member from another direction than that of FIG. 11A.

As depicted in FIGS. 3 and 4. FIGS. 5A and 5B, and FIGS. 8A to 8C, the cap lift holder 60 is approximately rectangular in planar view, and is formed into a concave shape opening at the upper surface. The cap holder 50 is contained in the concave cap lift holder 60 to be held by the cap lift holder 60. In more detail, a coil spring 97 is provided in an approximately central portion of an upper surface 61*a* of a bottom wall portion 61 of the concave cap lift holder 60 to form a lower portion. The cap holder 50 is fitted on an upper end of the coil spring 97 to be biased upward by the coil spring 97. Further, the cap holder 50 is enclosed throughout the circumference by such an edge wall portion 62 of the bottom wall portion 61 as projecting upward from an edge on the outer side of the cap holder 50.

Further, the edge wall portion 62 of the cap lift holder 60 is provided with three fitting portions 63*a* to fit the three projections 56*a*, and three fitting portions 63*b* to fit the three projections 56*b*. Then, the projections 56*a* engage with the fitting portions 63*a* while the projections 56*b* engage with the fitting portions 63*b*. By virtue of this, the cap holder 50 and the cap lift holder 60 are connected with each other. Further, the projections 56*a* and 56*b* are movable vertically in the fitting portions 63*a* and 63*b*. However, when moving in the fitting portions 63*a* and being positioned on the uppermost side, the projections 56*a* are positioned below the projections 56*b* when moving in the fitting portions 63*b* and being positioned on the uppermost side. By virtue of this, with the nozzle cap 63 separated from the ink jet surface 5*a*, at the projections 56*a* and 56*b*, the fitting portions 63*a* and 63*b* restrain the cap holder 50 biased upward by the coil spring 97 from moving upward. Hence, the nozzle cap 36 and the cap holder 50 are inclined with respect to the conveyance direction (see FIGS. 12A and 12B) such that the farther toward the downstream side in the conveyance direction, the farther positioned on the lower side. That is, the fitting portions 63*a* and 63*b* restrain the cap holder 50 from moving upward such that the part of the cap holder 50 on the downstream side in the conveyance direction may come below the part on the upstream side.

Further, a contact portion 64 projecting upward is provided at each end of a right end portion of the edge wall portion 62, on the upstream side and the downstream side in the conveyance direction. The contact portions 64 serve to contact with the right end of the ink jet head 5, with the carriage 3 in the maintenance position.

Further, an ink receiving portion 65 is provided in such a part of the cap lift holder 60 as overlapping vertically with the discharge port 54, for receiving the inks discharged from the discharge port 54. The ink receiving portion 65 is formed into a concave shape opening at the upper surface. Here, the concave ink receiving portion 65 has a lower part formed of a part of the bottom wall portion 61. Then, the ink receiving portion 65 is able to receive the inks on its upper surface 65*a*. Further, the bottom wall portion 61 has an enclosure wall 65*b* projecting upward from the part forming the edge of the upper surface 65*a* of the ink receiving portion 65, to enclose the upper surface 65*a*. By virtue of this, the inks received on the upper surface 65*a* are prevented from flowing out of the ink receiving portion 65. Further, a discharge port 67 opening at the upper surface 65*a* is provided in the right end of the ink receiving portion 65. Further, a cylindrical portion 66 is provided in such a part of a lower surface 61*c* of the bottom wall portion 61 as overlapping with the discharge port 67. The cylindrical portion 66 is formed into an approximately rectangular cylinder extending downward, and its inner space 66*a* is connected with the discharge port 67.

Here, when the cap holder 50 inclines as described earlier on, then because the cap holder 50 moves relative to the cap lift holder 60, the discharge port 54 deviates horizontally from the ink receiving portion 65. In this embodiment, no matter how the positional relation changes due to such a relative movement between the cap holder 50 and the cap lift holder 60, the discharge port 54 constantly overlaps vertically with the upper surface 65*a* of the ink receiving portion 65. That is, the relative movement between the cap holder 50 and the cap lift holder 60 is restricted to such an area that the discharge port 54 overlaps vertically with the upper surface 65*a* of the ink receiving portion 65. On this occasion, the projection 53*b* of the cylindrical portion 53 may be arranged to constantly overlap vertically with the discharge port 67. That is, the relative movement between the cap holder 50 and the cap lift holder 60 may be restricted to the area where the discharge port 54 overlaps vertically with the discharge port 67.

Further, in this embodiment, with the cylindrical portion 53, at least the lower end of the projection 53*b* is positioned constantly below the upper end of the enclosure wall 65*b* of the ink receiving portion 65. That is, the projection 53*b* is positioned on the inner side of the enclosure wall 65*b*, and overlaps vertically in position with the enclosure wall 65*b* (has a part positioned at the same height).

Further, four pawls 68 are provided to project downward, at the four corners of the lower surface 61*c* of the bottom wall portion 61 of the cap lift holder 60. Further, spring fitting portions 69 are provided respectively in such parts of the upper surface 61*a* of the bottom wall portion 61 as overlapping vertically with the two left pawls 68 of the four pawls 68. The spring fitting portions 69 are fitted with coil springs 98, respectively. Further, an opening portion 59 is formed in such a part of the bottom wall portion 61 and edge wall portion 62 as positioned on the left side of each of the spring fitting portions 69. The coil springs 98 are drawn out of the opening portions 59 to the outer side of the cap lift holder 60.

Further, the cap lift holder 60 is formed of, for example, a comparatively low hardness material such as polyacetal or the like.

(The Cap Lift Base)

As depicted in FIGS. 3 and 4, FIGS. 5A and 5B, FIGS. 9A and 9B, and FIGS. 10A to 10C, the cap lift base 70 has a frame portion 71 and a locker stand portion 72. The frame portion 71 is formed into a concave shape opening at the upper surface, and the cap lift holder 60 is contained in the frame portion 71 to be held by the frame portion 71. In more detail, the cap lift holder 60 is placed on the upper surface of a bottom wall portion 101 of the concave frame portion 71 to form a lower portion. Further, the cap lift holder 60 is enclosed throughout the circumference by the edge wall portion 102 projecting upward from such an edge of the bottom wall portion 101 as on the outer side of the cap lift holder 60. Further, the air release cap 37 is also held by the cap lift base 70.

Further, four through holes 103 are formed in the bottom wall portion 101 of the frame portion 71 to fit the respective pawls 68. The through holes 103 extend in the scanning direction, and the pawls 68 are movable in the scanning direction in the through holes 103. Further, spring fitting portions 109 are provided in the vicinity of the left two through holes 103 of the four through holes 103, in an upper surface 101*a* of the bottom wall portion 101. The spring fitting portions 109 are fitted with such ends of the coil springs 98 as at the opposite side from the spring fitting portions 69. The coil springs 98 are extension springs and the cap lift holder 60 is biased leftward by the biasing force of the coil springs 98.

Then, the cap lift holder 60 is biased leftward by the coil springs 98 while the four pawls 68 of the cap lift holder 60 are movable in the four through holes 103. By virtue of this, the cap lift holder 60 is able to move parallel within a horizontal plane and to rotate within the horizontal plane with respect to the frame portion 71. Here, the pawls 68 are movable only within the area where the through holes 103 are arranged. By virtue of this, the cap lift holder 60 is restricted in the range of the parallel moving within a horizontal plane and rotating within the horizontal plane with respect to the cap lift base 70.

Further, in this embodiment, the cap lift base 70 is provided with the through holes 103. However, instead of the through holes 103, recesses may be provided to fit the pawls 68. Further, projections may be provided on the upper surface of the frame portion 71 to project upward, while through holes or recesses opening at the lower surface may be provided in the bottom wall portion 61 of the cap lift holder 60.

Further, an ink receiving portion 104 is provided in such a part of the frame portion 71 as positioned below the cylindrical portion 66. The ink receiving portion 104 is formed into a concave shape opening at the upper surface. Here, the concave ink receiving portion 104 has a lower part formed of a part of the bottom wall portion 101. Then, the ink receiving portion 104 is able to receive the inks on its upper surface 104*a*. Further, the bottom wall portion 101 has an enclosure wall 104*b* projecting upward from a part forming an edge of the upper surface 104*a* of the ink receiving portion 104, so as to enclose the upper surface 104*a* By virtue of this, the inks received on the upper surface 104*a* are prevented from flowing out of the ink receiving portion 104. Further, a discharge port 106 is provided at the right end of the ink receiving portion 104 to open at the upper surface 104*a*. Further, a cylindrical portion 105 is provided on such a part of the upper surface 101*a* of the bottom wall portion 101 as to overlap with the discharge port 106. The cylindrical portion 105 is formed into an approximately rectangular cylinder extending downward, and its inner space 105*a* is connected with the discharge port 106.

Here, as described above, the cap lift holder 60 is rotatable within the horizontal plane with respect to the frame portion 71. In this embodiment, even when the cap lift holder 60 rotates within the horizontal plane with respect to the frame portion 71 such that their positional relation may change in any way, the discharge port 67 of the cap lift holder 60 still constantly overlaps vertically with the upper surface 104*a* of the ink receiving portion 104 of the frame portion 71. That is, the relative movement between the cap lift holder 60 and the cap lift base 70 is restricted to the area where the discharge port 67 overlaps vertically with the upper surface 104*a* of the ink receiving portion 104. Further, on this occasion, the discharge port 67 may constantly overlap with the discharge port 106. That is, the relative movement between the cap lift holder 60 and the cap lift base 70 may be restricted to the area where the discharge port 67 overlaps vertically with the discharge port 106.

Further, in this embodiment, even when the cap lift holder 60 rotates within the horizontal plane with respect to the frame portion 71 such that their positional relation may change in any way, the lower end of the cylindrical portion 66 is constantly positioned below the upper end of the enclosure wall 104*b* of the ink receiving portion 104. That is, the cylindrical portion 66 and the ink receiving portion 104 overlap in the vertical position and have parts positioned at the same height.

Further, ribs 107 are provided on the lower surface of the bottom wall portion 101 of the frame portion 71 to project downward and extend in the conveyance direction, respectively, in the vicinity of the parts overlapping with the two ends of the nozzle cap 36 in the scanning direction. A projection 107*a* is provided on the outer end surface of each of the ribs 107 in the scanning direction to project outward in the scanning direction. These two projections 107*a* align in the scanning direction. Further, two projections 108 are provided to align in the scanning direction, on the upstream end surface of the frame portion 71 in the conveyance direction. Each of the projections 108 projects toward the upstream side in the conveyance direction, and extends vertically.

The locker stand portion 72 is formed into an approximately cuboid shape elongated in the vertical direction. The locker stand portion 72 is provided at the left end on the outer circumference of the frame portion 71 on the downstream side in the scanning direction. Further, the locker stand portion 72 is provided with a carriage locker 111 to stand upward from its upper surface. The carriage locker 111 restrains the carriage 3 from moving in the scanning direction. The carriage locker 111 is formed into a cuboid shape. The carriage 3 is provided with a recess 3*a* larger in size than the carriage locker 111. With a leading end part of the carriage locker 111 contained in the recess 3*a*, the carriage 3 is restrained from moving in the scanning direction. In other words, the carriage locker 111 overlaps with the carriage 3 in the scanning direction, thereby restraining the carriage 3 from moving in the scanning direction. That is, when the carriage 3 attempts to move, then the inner wall surface of the recess 3*a* will contact with the right lateral surface of the carriage locker 111 on the right side in the scanning direction such that the carriage 3 is restrained from moving. Because the right lateral surface and the inner wall surface extend vertically parallel to each other, when the carriage 3 moves leftward to interfere with the carriage locker 111, then the carriage 3 is less likely to keep moving to let the inner wall surface slide upward to move relative to the right lateral surface. Therefore, even when the carriage 3 is caused to keep moving leftward, the carriage 3 will still not come up to cause the carriage locker 111 to come off the recess 3*a*. Hence, it is possible for the carriage locker 111 to restrain the carriage 3 from moving in the scanning direction. Further, the recess 3*a* may not be formed in the carriage 3. In such a case, the carriage locker 111 may contact with the left lateral surface of the carriage 3 to restrain the carriage 3 from moving.

Further, approximately cylindrical bosses 112*a* and 112*b* are provided to stand, respectively, in the vicinity of the upper end of the locker stand portion 72 and in the vicinity of the lower end on the left side from the left end. The bosses 112*a* and 112*b* overlap with the carriage locker 111 in the position in the conveyance direction. Further, ribs 113*a* and 113*b* are provided to stand on the left side in such parts of the bosses 112*a* and 112*b* as adjacent to the two sides in the conveyance direction, at the end on the left side of the locker stand portion 72. Here, the boss 112*a* and the rib 113*a* are positioned above the projection 107*a*. On the other hand, the boss 112*b* and the rib 113*b* are positioned more or less below the projection 107*a*. Further, a rib 114 is provided at the right end of the locker stand portion 72 to stand on the right side and extend vertically.

Further, the cap lift base 70 is formed of a higher hardness material than the cap lift holder 60 such as a resin mixture of polyphenylenether, polystyrene and glass fiber, etc.

(The Base Member)

As depicted in FIGS. 3 and 4, and FIGS. 11A and 11B, the base member 80 has a containing portion 121 for containing the cap lift base 70. The containing portion 121 supports the cap lift base 70 to be movable vertically. To explain in more detail, the containing portion 121 is provided with two guide portions 122 extending vertically and being arranged to sandwich the bosses 112*a* and 112*b* therebetween in the conveyance direction. The bosses 112*a* and 112*b* slide against the guide portions 122 to be guided vertically. Further, the containing portion 121 has a guide surface 124 which contacts with the leading end of the rib 114 and extends in the vertical and conveyance directions. The rib 114 is guided vertically along the guide surface 124. Further, the containing portion 121 is provided with two guide portions 123 extending to sandwich the two projections 108 of the frame portion 71 therebetween in the scanning direction. By virtue of this, the projections 108 slide with the guide portions 123 to be guided vertically. Then, due to those mechanisms, the cap lift base 70 is supported by the containing portion 121 to be movable vertically. Further, although the containing portion 121 has other configurations than the above configuration for supporting the cap lift base 70 to be movable vertically.

Further, the two bosses 112*a* and 112*b* aligning vertically are sandwiched between the two guide portions 122 in the conveyance direction. By virtue of this, the two bosses 112*a* and 112*b* are restrained from moving in the conveyance direction. By virtue of this, the bosses 112*a* and 112*b* are restrained from deviating in the conveyance direction such that the cap lift base 70 including the locker stand portion 72 is restrained from rotating about an axis along the scanning direction.

Further, the leading ends of the guide portions 122 are in contact with the ribs 113*a* and 113*b*. On the other hand, as described earlier on, the leading end of the rib 114 is in contact with the guide surface 124. By virtue of this, the locker stand portion 72 is sandwiched in the scanning direction between the guide portions 122 and the guide surface 124, respectively, in the part at the height where the rib 113*a* is arranged and in the part at the height where the rib 113*b* is arranged. Thereby, the locker stand portion 72 is restrained from moving in the scanning direction. By virtue of this, the locker stand portion 72 is restrained from the deviation in the scanning direction between the part at the height where the rib 113*a* is arranged and the part at the height where the rib 113*b* is arranged, such that the cap lift base 70 including the locker stand portion 72 is restrained from rotating about an axis along the conveyance direction.

Then, due to those mechanisms, the cap lift base 70 is restrained from rotating about an axis orthogonal to the vertical direction.

Further, in this embodiment, as described above, the bosses 112*a* and 112*b* are restrained from moving in the conveyance direction, while the locker stand portion 72 and the projections 108 are restrained from moving in the scanning direction. By virtue of this, the cap lift base 70 is also restrained from rotating within the horizontal plane.

Here, the base member 80 is fitted on the guide rails 11 and 12 of FIG. 1 and the frame 14 on the right side. However, the members fitted with the base member 80 are not limited to those. For example, the base member 80 may be fitted on some of the guide rails 11 and 12 and frame 14. Alternatively, the base member 80 may be fitted on a member supporting the frame from below (or a member for containing the recording paper P, etc.).

Further, a through hole 125 is formed in such a part of the containing portion 121 as to overlap vertically with the cylindrical portion 105. An ink foam 120 for absorbing the inks is arranged below the base member 80 at a position overlapping vertically with at least the through hole 125.

Here, in this embodiment, when the nozzle cap 36 is inclined, etc., as will be described later on, then the inks may spill from the nozzle cap 36 into the cap holder 50. On this occasion, the inks spilt into the cap holder 50 are received by the upper surface 51*a* of the bottom wall portion 51 of the cap holder 50. Further, those inks flow to the discharge port 57 along the border line 55 between the bottom wall portion 51 and the edge wall portion 52, so as to be discharged downward from the discharge port 54. The inks discharged from the discharge port 54 are received by the upper surface 65*a* of the ink receiving portion 65 of the cap lift holder 6). Then, the inks pass through the discharge port 67 and the inner space 66*a* of the cylindrical portion 66 to be discharged downward. The inks discharged from the discharge port 67 and the cylindrical portion 66 are received by the upper surface 104*a* of the ink receiving portion 104 of the cap lift base 70 and, thereafter, pass through the discharge port 106 and the inner space 105*a* of the cylindrical portion 105 to be discharged downward. Then, the inks discharged from the discharge port 106 and the inner space 105*a* of the cylindrical portion 105 pass through the through hole 125, and reach the ink foam 120 to be absorbed by the ink foam 120.

As described above, the base member 80 has not only the containing portion 121 for supporting the cap lift base 70 to be movable vertically but also a part fitted with the switch device 33 and the suction pump 32.

(The Slide Cam)

The slide cam 90 is a member extending along the conveyance direction, and can be moved reciprocatingly in the conveyance direction by an unshown drive mechanism. The slide cam 90 is supported by a plurality of ribs provided on such an inner bottom surface of the base member 80 as to form the containing portion 121, and configured to be slidable against the plurality of ribs. The slide cam 90 has two guide grooves 131 corresponding to the two projections 107*a* of the cap lift base 70. Through each of the guide grooves 131 is inserted the corresponding projection 107*a*. Each of the guide grooves 131 has three parallel portions 132*a* to 132*c*, and two inclined portions 133*a* and 133*b*.

The parallel portion 132*a* extends in parallel with the conveyance direction. The parallel portion 132*b* also extends in parallel with the conveyance direction and is arranged below the parallel portion 132*a* and on the upstream side from the parallel portion 132*a* in the conveyance direction. The parallel portion 132*c* also extends in parallel with the conveyance direction and is arranged below the parallel portion 132*b* and on the upstream side from the parallel portion 132*b* in the conveyance direction. The inclined portion 133*a* is arranged between the parallel portion 132*a* and the parallel portion 132*b* in the conveyance direction. The inclined portion 133*a* extends inclined with respect to the conveyance direction such that the farther toward the downstream side in the conveyance direction, the farther toward the upper side, and connects the parallel portion 132*a* and the parallel portion 132*b*. The inclined portion 133*b* is arranged between the parallel portion 132*b* and the parallel portion 132*c* in the conveyance direction. The inclined portion 133*b* extends inclined with respect to the conveyance direction such that the farther toward the downstream side in the conveyance direction, the farther toward the upper side, and connects the parallel portion 132*b* and the parallel portion 132*c*.

Then, when the projection 107*a* is positioned inside the parallel portion 132*a*, then the nozzle cap 36, air release cap 37, cap holder 50, cap lift holder 60 and cap lift base 70 are positioned at the uppermost side in the movable range. With the carriage 3 positioned in the maintenance position, when the nozzle cap 36 and the air release cap 37 are brought to that position, then the nozzle cap 36 is in close contact with the ink jet surface 5*a*. On this occasion, the rightmost nozzle row 10 is covered by the cap portion 36*a* while the left three nozzle rows 10 are covered by the cap portion 36*b*. Further, the opening portion 26*a* of the air release channel 26 is covered by the air release cap 37. Further, the position of the nozzle cap 36 on this occasion will be referred to below as the capping position.

Further, when the nozzle cap 36 and the like are moved to that position, then the contact portion 64 of the cap lift holder 60 comes to contact with the carriage 3 in the scanning direction. By virtue of this, in accordance with the inclination of the ink jet head 5, the cap lift holder 60 rotates within the horizontal plane with respect to the cap lift base 70. As a result, the nozzle cap 36, which rotates within the horizontal plane along with the cap lift holder 60, is adjusted in position to the inclination of the ink jet head 5.

Further, in this state, the carriage locker 111 provided on the cap lift base 70 is also positioned on the uppermost side in the moving range. Then, in this state, the carriage locker 111 overlaps with the carriage 3 in the scanning direction. In this state, the carriage locker 111 restrains the carriage 3 in the maintenance position from moving leftward in the scanning direction.

Figure 12A:
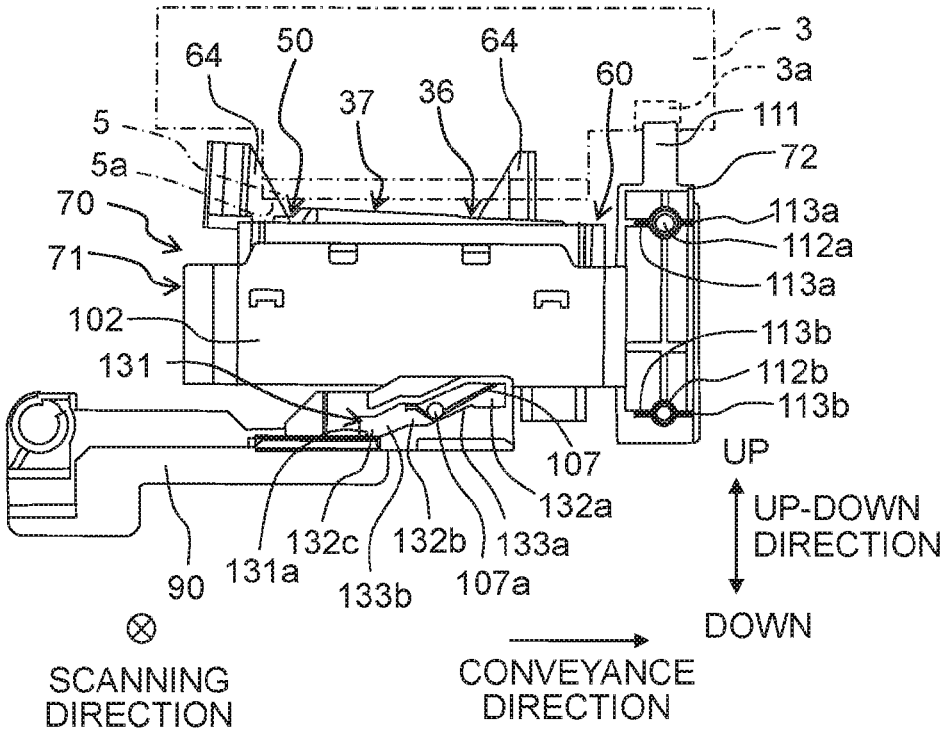
FIG. 12A corresponds to FIG. 6A, with the nozzle cap separated from an ink jet surface.

From this state, when the slide cam 90 is moved downstream in the conveyance direction, then the projection 107*a* slides against an inner wall surface 131*a* of the groove 131, and moves from the parallel portion 132*a* to the inclined portion 133*a*. By virtue of this, as depicted in FIG. 12A, the nozzle cap 36, air release cap 37, cap holder 50, cap lift holder 60 and cap lift base 70 descend to separate the nozzle cap 36 from the ink jet surface 5*a*. Then, when the projection 107*a* moves to the parallel portion 132*b*, the nozzle cap 36 is positioned at a predetermined height away from the ink jet surface 5*a*. Further, the position of the nozzle cap 36 on this occasion will be referred to below as the intermediate position.

Figure 12B:
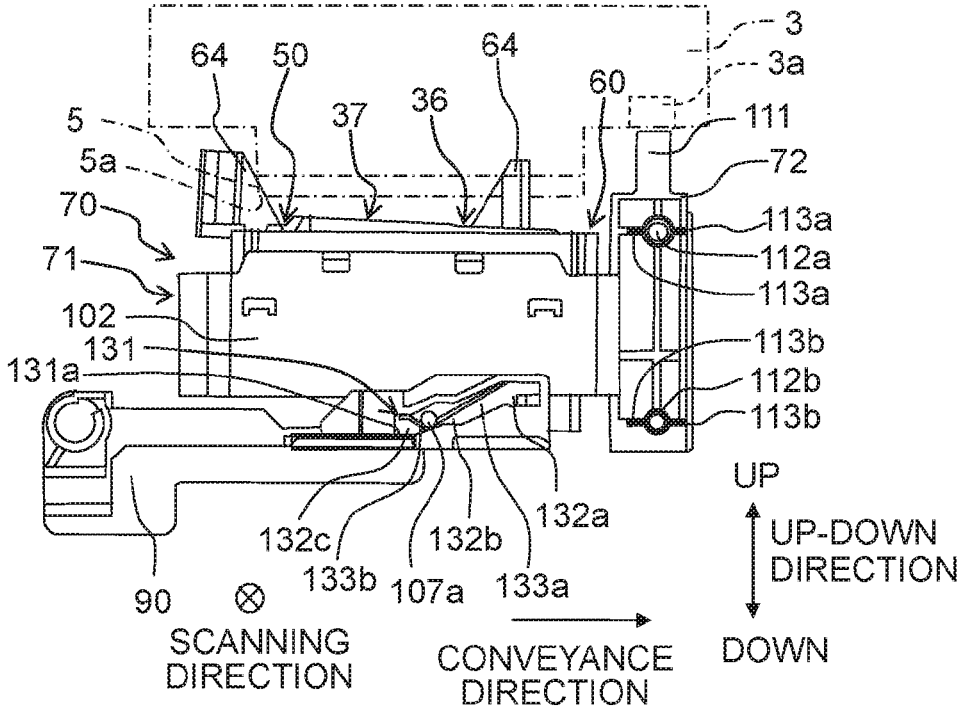
FIG. 12B also corresponds to FIG. 6A, with the nozzle cap further separated from the ink jet surface than in FIG. 12A.

When the slide cam 90 is moved further downstream in the conveyance direction, then the projection 107*a* slides against the inner wall surface 131*a* of the groove 131, and moves from the parallel portion 132*a* to the inclined portion 133*b*. By virtue of this, as depicted in FIG. 12B, the nozzle cap 36, air release cap 37, cap holder 50, cap lift holder 60 and cap lift base 70 further descend. Then, when the projection 107*a* moves to the parallel portion 132*c*, the nozzle cap 36 is positioned at the lowermost height in the moving range. Further, the position of the nozzle cap 36 on this occasion will be referred to below as the retreat position.

Further, from this state, when the slide cam 90 is moved upstream in the conveyance direction, then contrary to the above situation, the projection 107*a* slides against the inner wall surface 131*a* of the groove 131, and moves in the following order to the parallel portion 132*c*, the inclined portion 133*b*, the parallel portion 132*b*, the inclined portion 133*a*, and the parallel portion 132*a*. Thereby, the nozzle cap 36, air release cap 37, cap holder 50, cap lift holder 60 and the cap lift base 70 ascend from the retreat position to the capping position via the intermediate position.

Here, when the cap lift base 70 ascends or descends, then the carriage locker 111 also ascends or descends. Then, with the nozzle cap 36 above a predetermined uncapping position between the intermediate position and the retreat position, the descending carriage locker 111 overlaps with the carriage 3 in the scanning direction, thereby restraining the carriage 3 from moving in the scanning direction. On the other hand, as depicted in FIG. 12B, with the nozzle cap 36 below the predetermined uncapping position between the intermediate position and the retreat position, the carriage locker 111 does not overlap with the carriage 3 in the scanning direction. When the nozzle cap 36 is in the uncapping position, the carriage locker 111 does not overlap with the carriage 3 in the scanning direction. That is, the arrival of the nozzle cap 36 at the uncapping position starts releasing the carriage 3 from the restraint from moving in the scanning direction due to the carriage locker 111.

Further, with the nozzle cap 36 separate from the ink jet surface 5*a*, as depicted in FIGS. 12A and 12B and as described above, the nozzle cap 36 and the cap holder 50 are inclined with respect to the conveyance direction such that the downstream parts in the conveyance direction are positioned below the upstream parts. That is, the nozzle cap 36 and the cap holder 50 are inclined such that the downstream parts in the conveyance direction may come away from the ink jet surface 5*a*. Further, the cap lift holder 60 is also more or less inclined. To explain in more detail, when it is supposed to strictly restrain the cap lift holder 60 from inclination with respect to the conveyance direction, then the cap lift holder 60 is liable to be hindered from a smooth rotation within the horizontal plane with respect to the cap lift base 70. Therefore, it is not possible to strictly restrain the cap lift holder 60 from inclination in the conveyance direction. Hence, the cap lift holder 60 is more or less inclined in the conveyance direction.

When the cap lift holder 60 is inclined with respect to the conveyance direction, then the cap lift holder 60 moves relative to the cap lift base 70 such that the discharge port 67 and the cylindrical portion 66 deviate from the ink receiving portion 104 in the conveyance direction. In this embodiment, the nozzle cap 36 is in contact with the ink jet surface 5*a*, so that when the nozzle cap 36 and the like are not inclined, then the discharge port 67 of the cap lift holder 60 overlaps vertically with the upper surface 104*a* of the ink receiving portion 104 of the frame portion 71. Further, even when the nozzle cap 36 is separate from the ink jet surface 5*a* such that the nozzle cap 36 and the like are inclined, the discharge port 67 of the cap lift holder 60 still overlaps vertically with the upper surface 104*a* of the ink receiving portion 104 of the frame portion 71.

The switch device 33 is, as described earlier on, connected with the cap portions 36*a* and 36*b* and the air release cap 37. Further, the switch device is connected with the suction pump 32 via the tube. The switch device 33 switches the connection of the suction pump 32 with the cap portions 36*a* and 36*b* and the air release cap 37. The waste liquid tank 34 is connected to the suction pump 32 on the opposite side from the switch device 33. Then, under the control of the controller 100, the printer 1 can carry out a suction purge. In the suction purge, the suction pump 32 is driven after connecting either of the cap portions 36*a* and 36*b* with the suction pump with the nozzles 18 covered by the nozzle cap 36. By virtue of this, the inks in the ink jet head 5 is discharged from the nozzles 18 into the cap portions 36*a* and 36*b*. Further, after the suction purge, it is possible to drive the suction pump 32 after the nozzle cap 36 is brought to the intermediate position. By virtue of this, it is possible to carry out an air suction to discharge the liquid accumulated in the cap portions 36*a* and 36*b*. Further, the suction pump 32 is driven after the air release cap 37 is connected with the suction pump 32, with the nozzles 18 covered by the nozzle cap 36. By virtue of this, it is possible to carry out an air purge to release the air from the air release channel 26. The waste liquid tank 34 retains the inks discharged in the suction purge and the air suction.

Here, when the printer 1 is in a standby state without carrying out any printing, the carriage 3 is placed in the maintenance position while the nozzle cap 36 is placed in the capping position. Then, as soon as a print instruction is inputted to the printer 1, firstly as described above, the nozzle cap 36 and the like are caused to descend. Then, when the nozzle cap 36 descends to a position lower than the uncapping position, then the carriage locker 111 no longer overlaps with the carriage 3 in the scanning direction. That is, the carriage locker 111 no longer overlaps with the carriage 3 as viewed from a direction orthogonal to the scanning direction. Thereafter, the carriage 3 is moved to start printing. Further, in this embodiment, after starting printing in this manner, the nozzle cap 36 further descends down to the retreat position.

Further, in this embodiment, when each of the projections 107*a* of the cap lift base 70 passes the inclined portions 133*a* and 133*b* of the groove 131 of the slide cam 90, a force is applied to the projection 107*a* from such a part of the inner wall surface 131*a* of the groove 131 as to form the inclined portions 133*a* and 133*b*. By virtue of this, the cap lift base 70 moves vertically. On this occasion, the force applied to the projection 107*a* includes a component along the conveyance direction, in addition to the vertical component. Further, in this embodiment, the projection 107*a* is only inserted through the groove 131.

Suppose that the cap lift base 70 is not restrained from rotating about the axis orthogonal to the conveyance direction. In this case, when the force having the component along the conveyance direction is applied to the projection 107*a* as described above, the projection 107*a* is liable to revolve in the groove 131 about an axis along the scanning direction. Further, along with this, the cap lift base 70 is liable to rotate about an axis along the scanning direction. Thus, the carriage locker 111 is more likely to incline.

Ordinarily, with the carriage locker 111 being not inclined, when the nozzle cap 36 descends through a predetermined descending distance, then the upper end of the carriage locker 111 moves below the recess 3*a*. On this occasion, the carriage locker 111 does not overlap with the carriage 3 in the scanning direction. However, according to the configuration as depicted in the above one example, when the nozzle cap 36 and the like descend, the carriage locker 111 is liable to incline. In this case, according to the way of inclination, even at the point of the nozzle cap 36 having descended through the predetermined descending distance, the upper end of the carriage locker 111 is still positioned in the recess 3*a*. That is, the upper end of the carriage locker 111 overlaps with the carriage 3 in the scanning direction. Therefore, it is indispensable to consider that the carriage locker 111 may incline. That is, the carriage 3 must start to move after the carriage locker 111 has moved through the predetermined descending distance or more. That is, considering the inclination of the carriage locker 111, it is necessary to start moving the carriage 3 after the carriage locker 111 has descended through a descending distance set to be longer than the predetermined descending distance through which the carriage locker 111 without inclination descends below the recess 3*a*. As a result, because the carriage 3 is able to move after a print instruction is inputted, a longer time is spent before the print is started.

In contrast to the above situation, in this embodiment, the cap lift base 70 is restrained from rotating about the axis orthogonal to the vertical direction as described earlier on. Then, the carriage locker 111 is provided on the cap lift base 70 restrained from such rotation. By virtue of this, it is possible to prevent the carriage locker 111 from inclination when the nozzle cap 36 and the like descend. That is, in this embodiment, when the nozzle cap 36 arrives at the uncapping position, the cap lift base 70 is restrained from rotation such that the rotating range of the carriage locker 111 may not overlap with the carriage 3 in the scanning direction. Therefore, it is not necessary to assume the inclination of the carriage locker 111. Hence, the carriage 3 and the carriage locker 111 will not interfere with each other even when the carriage 3 starts to move at the point of the carriage locker 111 having descended through a predetermined descending distance which is the minimum descent for the carriage locker 111 not to overlap with the carriage 3. As a result, it is not necessary for the carriage 3 to start moving after the carriage locker 111 has descended through such a descending distance as set to be longer than the predetermined descending distance. That is, it is possible for the carriage 3 to start moving at the point of the carriage locker 111 having descended through the predetermined descending distance. By virtue of this, it is not necessary for the carriage 3 to wait to start moving for the time to descend through an extra distance in addition to the predetermined descending distance as in a conventional manner. Hence, it is possible to for the carriage 3 to start moving earlier than conventional. Therefore, after the print instruction is inputted, it is possible to shorten the time from the carriage 3 being able to move to the print being started.

Further, in this embodiment, the cap lift holder 60 is fitted to be rotatable within the horizontal plane with respect to the cap lift base 70, and the cap lift base 70 is restrained from rotating about the axis orthogonal to the vertical direction with respect to the base member 80. That is, the cap lift holder 60 and the cap lift base 70 play the respective roles of the function of rotating within the horizontal plane according to the inclination of the ink jet head 5 and the function of transmitting the power to raise and lower the cap holder 50 in the vertical direction. Then, the carriage locker 111 is provided on the cap lift base 70 which is not required to rotate smoothly within the horizontal plane. By virtue of this, it is possible to reliably prevent the carriage locker 111 from inclination by strictly restraining the cap lift base 70 from rotating about the axis orthogonal to the vertical direction.

Further, in this embodiment, in order for the carriage locker 111 not to contact with the ink jet surface 5*a*, the locker stand portion 72 is provided on the outer side of the frame portion 71 of the cap lift base 70, while the carriage locker 111 is provided on the locker stand portion 72. Further, the locker stand portion 72 is provided with the bosses 112*a* and 112*b* and the ribs 113*a*, 113*b* and 114 for restraining the cap lift base 70 from rotating about the axis orthogonal to the vertical direction.

By virtue of this, the boss 112*a* and the rib 113*a*, as well as part of the rib 114, are arranged closer to the carriage locker 111 than the projection 107*a* to which the force is applied from the slide cam 90, in both the conveyance direction and the vertical direction. Therefore, at the position close to the carriage locker 111, the cap lift base 70 is restrained from rotating about the axis orthogonal to the vertical direction such that it is easier to prevent the carriage locker 111 from inclination than the case of restraining the cap lift base 70 from the rotation at a position farther away from the carriage locker 111.

Further, because it is possible for the carriage locker 111 to collide with the carriage 3, the carriage locker 111 is required to have a high strength to a certain degree. On the other hand, when rotating within the horizontal plane for position adjustment to the inclination of the ink jet head 5, the cartridge holder 6 slides against the ink jet head 5. Hence, the cap lift holder 60 cannot be formed of a material of so high a hardness. In contrast to this, because of not sliding against the ink jet head 5, the cap lift base 70 can be formed of a material of a high hardness. Here, in this embodiment, the cap lift base 70 is formed of a material of a higher hardness than the cap lift holder 60. By virtue of this, it is possible to raise the strength of the carriage locker 111 provided on the cap lift base 70.

Figure 13A:
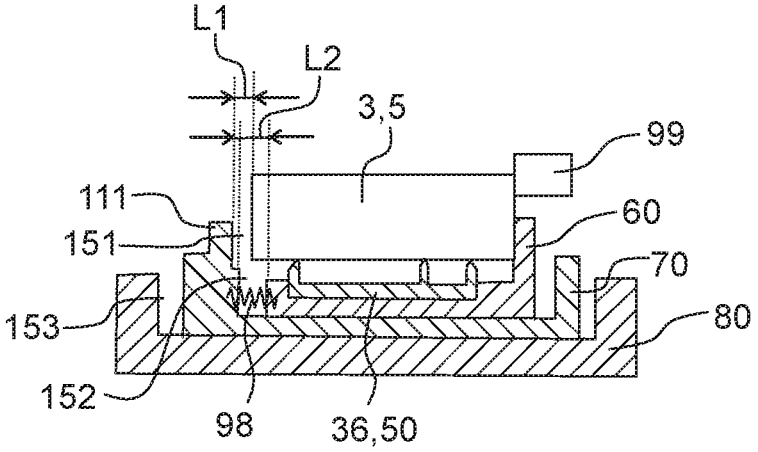

Further, in this embodiment, with the carriage 3 in the maintenance position and the nozzle cap 36 in the capping position, as depicted in FIG. 13A, an interspace 151 is formed between the carriage 3 and the carriage locker 111. Further, backlashes 152 and 153 are present, respectively, between the cap lift holder 60 and the cap lift base 70 and between the cap lift base 70 and the base member 80. The backlash 153 between the cap lift base 70 and the base member 80 is set such that when the carriage locker 111 is inclined by the cap lift base 70 rotating about the axis orthogonal to the conveyance direction, the carriage locker 111 may not overlap with the carriage 3 in the scanning direction. Further, in the scanning direction, the length L1 of the interspace 151 between the carriage 3 and the carriage locker 111 is shorter than the length L2 of the backlash 152 between the cap lift holder 60 and the cap lift base 70 (the length of the backlash between the cap and the moving member of the present teaching). Further, in FIG. 13A and the like, for the sake of convenience, one member depicts the combination of the carriage 3 and the ink jet head 5 while another one member depicts the combination of the nozzle cap 36 and the cap holder 50. Further, in this state, the right end of the carriage 3 is in contact with one frame 99 of the printer 1 such that the carriage 3 cannot move further rightward (in FIG. 1 and the like, illustration of the frame 99 is omitted). The frame 99 is, for example, such a member as provided either integrally with the ends of the guide rails 11 and 12 or separately from the guide rails 11 and 12 to serve as a reference for detecting the origin position of the carriage 3.

Here, with the carriage 3 in the maintenance position and the nozzle cap 36 in the capping position, due to the detent torque of the carriage motor 16, a force produced in the cap lift holder 60 is larger than the biasing force of the coil springs 98. Hence, due to the biasing force of the coil springs 98, the cap lift holder 60 does not move leftward so as to maintain such a positional relation as depicted in FIG. 13A between the carriage 3, the nozzle cap 36, the cap holder 50, the cap lift holder 60, the cap lift base 70, and the base member 80.

In this state, consider a case where due to accidently dropping the printer 1 in transportation or the like, for example, an external force is applied to the cap lift holder 60 and is larger than the force produced therein due to the detent torque of the carriage motor 16. In such a case, the cap lift holder 60 is pulled by the biasing force of the coil springs 98. Thereby, the carriage 3, nozzle cap 36, cap holder 50 and cap lift holder 60 move leftward.

Figure 14A:
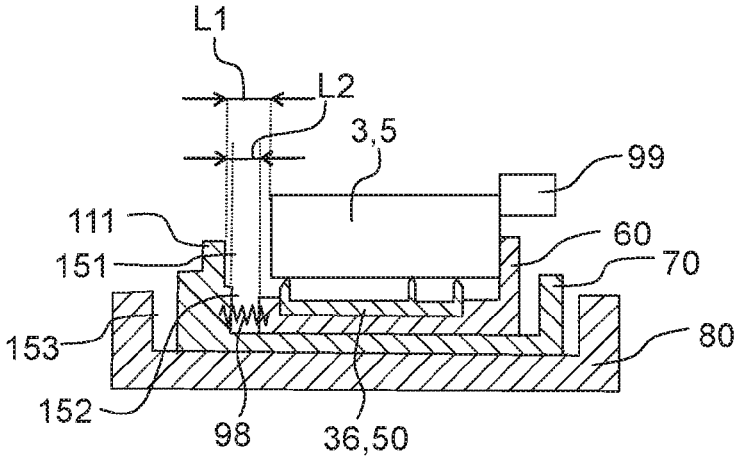

Here, as depicted in FIG. 14A, consider such a case that the length L1 of the interspace between the carriage 3 and the carriage locker 111 is longer than the length L2 of the interspace between the cap lift holder 60 and the cap lift base 70 (this example is taken as a comparative example).

Figure 14B:
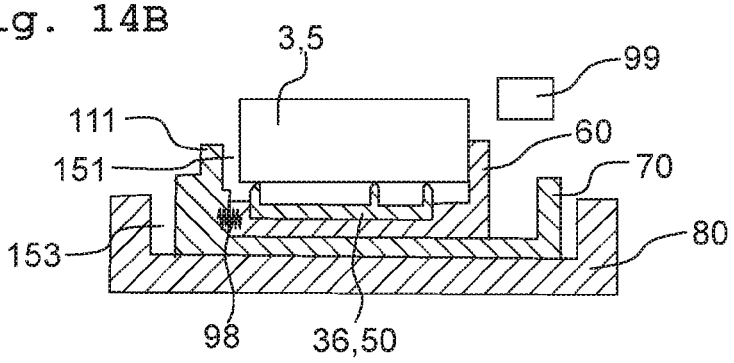

In the case of the comparative example, as described above, when the cap lift holder 60 is pulled due to the biasing force of the coil springs 98, the carriage 3, nozzle cap 36, cap holder 50 and cap lift holder 60 move integrally leftward. On this occasion, as depicted in FIG. 14B, those members first move leftward until the cap lift holder 60 comes to contact with the cap lift base 70.

Figure 14C:
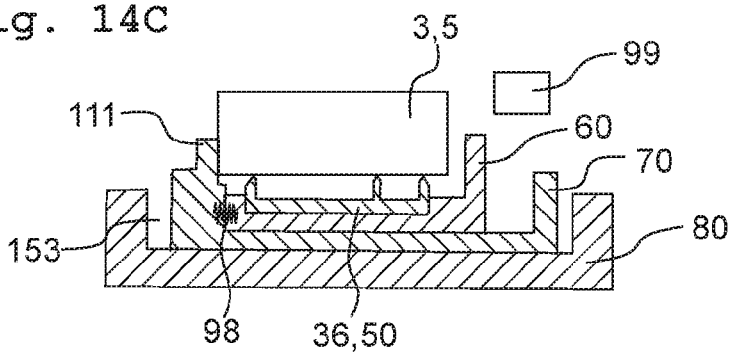

Further, thereafter as depicted in FIG. 14C, the carriage 3 moves leftward independently from the nozzle cap 36, cap holder 50 and cap lift holder 60, until contacting with the carriage locker 111. On this occasion, a positional deviation arises between the ink jet surface 5*a* and the nozzle cap 36. When such a deviation arises, then the nozzles 18 are liable to contact with such a part of the nozzle cap 36 as in contact with the ink jet surface 5*a*, or the nozzles 18 are liable to move beyond the cap portions 36*a* and 36*b*.

Further, in the case of the comparative example, after the carriage 3, nozzle cap 36, cap holder 50 and cap lift holder 60 move integrally and, further, because the carriage 3 moves independently from the nozzle cap 36, cap holder 50 and cap lift holder 60, the carriage 3 mounted with the comparatively heavy ink jet head 5 moves through a longer distance until contacting with the carriage locker 111. When the carriage 3 moves through a longer distance, then the carriage locker 111 is subject to a larger impact when the carriage 3 comes into contact with the carriage locker 111.

Figure 14D:
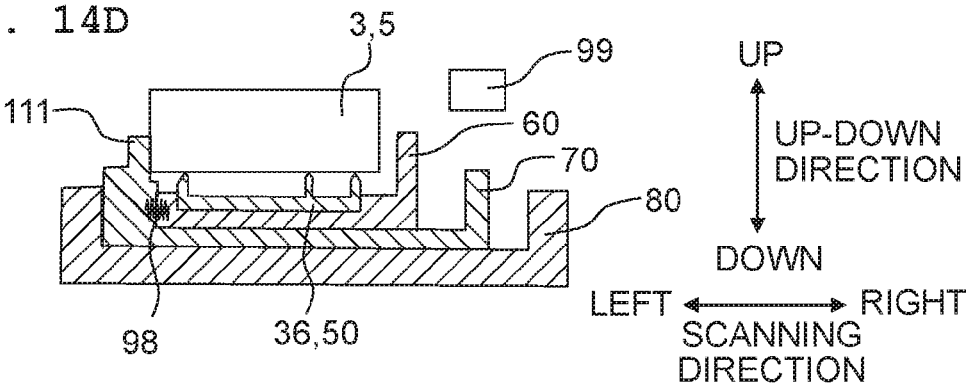

Further, in the case of the comparative example, thereafter as depicted in FIG. 14D, the carriage 3, nozzle cap 36, cap holder 50, cap lift holder 60 and cap lift base 70 move integrally until contacting with the base member 80. On this occasion, too, when the heavy carriage 3 moves through a long distance to contact with the carriage locker 111, then the base member 80 is subject to a larger impact.

Figure 13B:
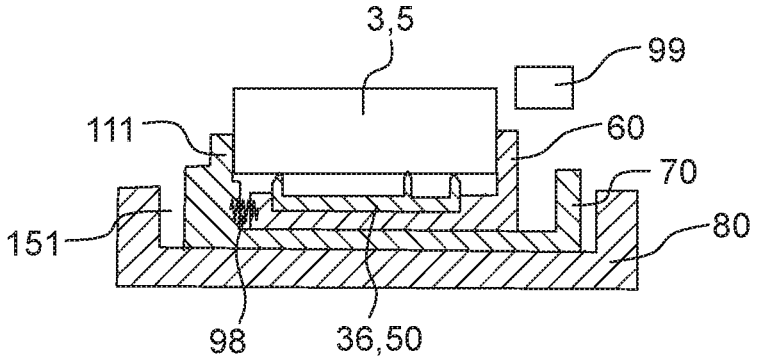

In contrast to the above, in this embodiment, as mentioned earlier on, the length L1 is shorter than the length L2. As described above, when the cap lift holder 60 is pulled due to the biasing force of the coil springs 98, the nozzle cap 36, cap holder 50 and cap lift holder 60 move leftward. On this occasion, as depicted in FIG. 13B, those members move until the carriage 3 comes into contact with the carriage locker 111. Since the carriage 3 is in contact with the contact portion 64 of the cap lift holder 60, the carriage 3 thereafter will not move relative to the cap lift holder 60 in the scanning direction. Therefore, there is no positional deviation between the ink jet surface 5*a* and the nozzle cap 36. Further, in this case, it is possible to for the carriage 3 to have a shorter moving distance until contacting with the carriage locker 111 than in the case of the comparative example. By virtue of this, when the carriage 3 comes into contact with the carriage locker 111, it is possible to reduce the impact on the carriage locker 111.

Figure 13C:
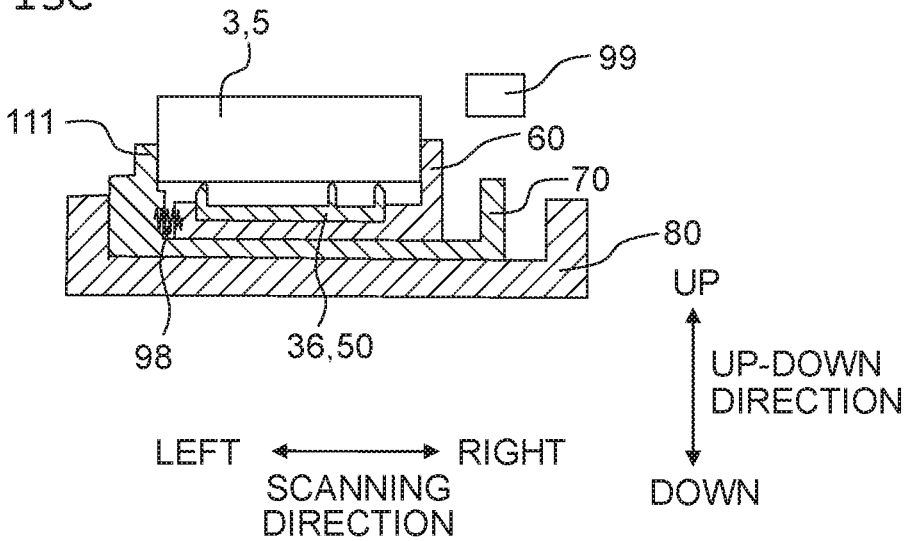

Further, in this embodiment, too, thereafter as depicted in FIG. 13C, the carriage 3, nozzle cap 36, cap holder 50, cap lift holder 60 and cap lift base 70 move integrally until contacting with the base member 80. In this embodiment, because the carriage 3 moves through a short distance to contact with the carriage locker 111, it is possible to reduce the impact on the base member 80 at that time.

Further, in this embodiment, the cap lift base 70 is not only restrained from rotating about the axis orthogonal to the vertical direction but also restrained from rotating within the horizontal plane. By virtue of this, it is possible to restrain the nozzle cap 36 from rotation and/or deviation due to other factors than the rotation of the cap lift holder 60.

Further, in this embodiment, the printer 1 corresponds to the liquid discharge apparatus of the present teaching. Further, the ink jet head 5 corresponds to the liquid discharge head of the present teaching. Further, the combination of the cap holder 50, cap lift holder 60, cap lift base 70, base member 80 and slide cam 90 corresponds to the cap moving device of the present teaching. Further, the cap lift holder 60 corresponds to the cap holding member of the present teaching. Further, the cap lift base 70 corresponds to the moving member of the present teaching. Further, the bosses 112*a* and 112*b* and the ribs 113*a*, 113*b* and 114 correspond to the contact portion of the present teaching. Further, the guide portions 122 and 123 and the guide surface 124 play both roles of the guide portion and the restraint portion of the present teaching. Further, the projections 107*a* correspond to the drive force receiving portion of the present teaching. Further, the slide cam 90 corresponds to the cam portion of the present teaching while the inner wall surface 131*a* of the groove 131 corresponds to the cam surface of the present teaching. Further, the vertical direction or the directional term "vertical/vertically" corresponds to the first direction of the present teaching. Further, the scanning direction corresponds to the second direction of the present teaching. Further, the conveyance direction corresponds to the third direction of the present teaching.

Next, explanations will be made on a few modifications applying various changes to the above embodiment.

In the above embodiment, the cap lift base 70 is restrained both from the rotation about the axis orthogonal to the vertical direction and from the rotation within the horizontal plane. However, without being limited to this, the cap lift base 70 may be restrained only from the rotation about the axis orthogonal to the vertical direction.

Further, in the above embodiment, the cap lift base 70 is formed of a higher hardness material than the cap lift holder 60. However, without being limited to this, for example, the cap lift base 70 may be formed of the same material as the cap lift holder 60. Further, the cap lift base 70 may be formed of a lower hardness material than the cap lift holder 60.

Further, in the above embodiment, the bosses 112*a* and 112*b* and the ribs 113*a*, 113*b* and 114 are provided on the locker stand portion 72 arranged on the outer side of the frame portion 71 for the carriage locker 111 to stand thereon, so as to contact with the base member 80 for restraining the cap lift base 70 from rotating. However, without being limited to this, for example, at least some parts of those members may be provided on other parts than the locker stand portion 72 of the cap lift base 70 such as on the frame portion 71 and the like.

Further, in such cases, such a part of the cap lift base 70 as in contact with the base member 80 for the rotation restraint may not include the part arranged at a farther position from the carriage locker 111 than the projections 107*a* subject to the force from the slide cam 90, in the conveyance direction and the vertical direction. That is, all parts of the cap lift base 70 in contact with the base member 80 for the rotation restraint may be arranged at farther positions from the carriage locker 111 than the projections 107*a*, in either the conveyance direction or the vertical direction.

Further, in the above embodiment, the cap lift base 70 is provided with the two projections 107*a* to be subjected to the force from the slide cam 90. However, without being limited to this, for example, the cap lift base 70 may be provided with one projection 107*a* or three or more projections 107*a* aligning in one row in the scanning direction while one groove 131 or three or more grooves 131 may be provided in the slide cam 90 to correspond to the respective projections 107*a*.

Further, the moving direction of the slide cam 90 is not limited to the conveyance direction. The moving direction of the slide cam 90 may be another horizontal direction. Further, in such a case, the two projections 107*a* align in such a direction as horizontal and orthogonal to the moving direction of the slide cam 90.

Further, in the above embodiment, the cap lift base 70 is raised and lowered by way of applying a force to the projections 107*a* from the inner wall surfaces 131*a* of the grooves 131 of the slide cam 90. However, without being limited to this, for example, such an arm as disclosed in Japanese Patent Application Laid-Open No. 2009-208271 may be provided to apply a force to the projections 107*a*. In this case, too, because the force applied to the projections 107*a* has not only the vertical component but also a component along the conveyance direction. Therefore, when the cap lift base 70 is not restrained from rotation, then the cap lift base 70 is liable to rotate due to the force applied to the projections 107*a*. Further, in this case, the parts to which the force is applied for moving the cap lift base 70 may be configured in another form than projections.

Further, in the above embodiment, the force applied for raising and lowering the cap lift base 70 has the component along the direction orthogonal to the vertical direction. However, without being limited to this, the force applied for raising and lowering the cap lift base 70 may have only the vertical component. In this case, too, it is necessary to restrain the cap lift base 70 from rotation due to other factors than the force applied for the raising and lowering.

Further, in the above embodiment, the guide portions 122 and 123 and the guide surface 124 for guiding the cap lift base 70 of the base member 80 along the vertical direction serve also as the restraint portion to restrain the cap lift base 70 from rotating about the axis orthogonal to the vertical direction. However, the present teaching is not limited to such an aspect. The base member 80 may be provided respectively with a guide portion for guiding the cap lift base 70 in the vertical direction and a restraint portion to restrain the cap lift base 70 from rotating about the axis orthogonal to the vertical direction. Further, in this case, the restraint portion is not limited to being provided on the base member 80 having the guide portion. The restraint portion may be provided on another member than the base member 80 having the guide portion.

Further, in the above embodiment, the length L1 of the interspace 151 between the carriage 3 and the carriage locker 111 is shorter than the length L2 of the backlash 152 between the cap lift holder 60 and the cap lift base 70. However, the present teaching is not limited to such an aspect. The length L1 of the interspace 151 may be set as not longer than the length L2 of the backlash 152.

Further, in the above embodiment, the cap holder 50 and the cap lift holder 60 are different members. However, the present teaching is not limited to such an aspect. A single member may be provided to integrate the cap holder 50 and the cap lift holder 60. Further, in this case, the above single member corresponds to the cap holding member of the present teaching. Alternatively, the nozzle cap 36 may be held directly on the cap lift base 70 to be rotatable within the horizontal plane. In this case, the length L1 of the interspace 151 may be shorter than the length of a backlash between nozzle cap 36 and the cap lift base 70.

Further, in the above embodiment, the nozzle cap 36, cap holder 50, cap lift holder 60 and cap lift base 70 are moved in the vertical direction. However, those members may be moved in another direction which intersects the liquid jet surface and is inclined with respect to the vertical direction.

Further, in the above embodiment, the uncapping position is located between the intermediate position and the retreat position. However, the present teaching is not limited to such an aspect. For example, the uncapping position may be located between the capping position and the intermediate position. Further, there may be no such intermediate position as in the above embodiment, and the uncapping position may be located between the capping position and the retreat position.

Further, the above explanation is made on an example of applying the present teaching to an ink jet printer jetting inks from nozzles to carry out printing. However, the present teaching is not limited to such an aspect. For example, it is also possible to apply the present teaching to liquid discharge apparatuses jetting a liquid other than inks such as a wiring pattern material for a wiring substrate.

What is claimed is:

1. A liquid discharge apparatus comprising:

a liquid discharge head including a nozzle surface having a nozzle;

a carriage mounting the liquid discharge head thereon and being movable in a first direction;

a cap configured to contact with the liquid discharge head to cover the nozzle; and a cap moving mechanism configured to move the cap in a second direction intersecting the nozzle surface to locate the cap in a capping position in contact with the liquid discharge head to cover the nozzle, and in an uncapping position separated away from the liquid discharge head, the cap moving mechanism including:

a moving member holding the cap to be rotatable about a first rotational axis orthogonal to the nozzle surface and configured to move integrally with the cap in the second direction;

a carriage locker provided on the moving member to rotate integrally with the moving member and configured to restrain the carriage from moving in the first direction, the carriage locker overlapping with the carriage in the first direction with the cap in the capping position, and not overlapping with the carriage in the first direction with the cap in the uncapping position; and a restraint portion configured to restrain the moving member from rotating about a second rotational axis orthogonal to the second direction, wherein the restraint portion restrains the moving member from rotating such that when the cap arrives in the uncapping position, a rotating range of the carriage locker rotated with the moving member does not overlap with the carriage in the first direction.

2. The liquid discharge apparatus according to claim 1, wherein the carriage locker is configured to restrain the carriage from moving in the first direction by contacting with the carriage.

3. The liquid discharge apparatus according to claim 1, wherein the restraint portion is configured to restrain the moving member from rotating about the second rotational axis by contacting with the moving member.

4. The liquid discharge apparatus according to claim 1, wherein the cap moving mechanism moves the cap in the second direction to locate the cap in the capping position, in the uncapping position, and in a retreat position farther away from the liquid discharge head than the uncapping position.

5. The liquid discharge apparatus according to claim 1, wherein the cap moving mechanism includes a base member including a guide portion guiding the moving member in the second direction, and wherein the restraint portion is provided on the base member.

6. The liquid discharge apparatus according to claim 1, wherein the carriage locker includes an interspace in the first direction between the carriage locker and the carriage with the cap in the capping position;

wherein the cap is fitted to have a predetermined backlash from the moving member in the first direction; and wherein in the first direction, the length of the interspace between the carriage and the carriage locker is shorter than the length of the backlash between the cap and the moving member.

7. The liquid discharge apparatus according to claim 1, wherein the moving member includes a moving force reception portion and a cam portion connected with the moving force reception portion to apply a force to the moving force reception portion for moving the moving member in the second direction.

8. The liquid discharge apparatus according to claim 7, wherein the moving force reception portion includes a plurality of moving force reception portions aligned in one row in a third direction orthogonal to the second direction.

9. The liquid discharge apparatus according to claim 8, wherein the cam portion is movable in a fourth direction orthogonal to both the second direction and the third direction, and includes a cam surface extending along the fourth direction and inclining with respect to the fourth direction; and wherein the moving force reception portion is configured to contact with the cam surface.

10. The liquid discharge apparatus according to claim 7, wherein the moving force reception portion is connected with the cam portion to be rotatable with the third direction as a rotational axis;

wherein the carriage locker is arranged away from the moving force reception portion in a fourth direction orthogonal to both the second direction and the third direction; and wherein the moving member includes a contact portion contactable with the restraint portion, the contact portion being arranged in a position closer to the carriage locker than the moving force reception portion respectively in the second direction and in the fourth direction.

11. The liquid discharge apparatus according to claim 10, wherein the moving member includes a frame holding the cap and having the moving force reception portion, and a locker stand portion arranged on an outer side of the frame such that the carriage locker stands on the locker stand portion in the second direction; and wherein the contact portion stands from the locker stand portion in a direction orthogonal to the second direction.

12. The liquid discharge apparatus according to claim 1, further comprising a cap holding member held by the moving member to be rotatable within the nozzle surface to hold the cap, wherein the moving member is made of a higher hardness material than the cap holding member.

13. A liquid discharge apparatus comprising:

a liquid discharge head including a nozzle surface having a nozzle;

a carriage mounting the liquid discharge head thereon and being movable in a first direction;

a cap configured to contact with the liquid discharge head to cover the nozzle; and a cap moving mechanism configured to move the cap in a second direction intersecting the nozzle surface to locate the cap in a capping position in contact with the liquid discharge head to cover the nozzle, and in an uncapping position separated away from the liquid discharge head, the cap moving mechanism including:

a moving member holding the cap to be rotatable within the nozzle surface and to move integrally with the cap in the second direction;

a carriage locker provided on the moving member, the carriage locker overlapping with the carriage in the first direction with the cap in the capping position, and not overlapping with the carriage in the first direction with the cap in the uncapping position; and a base member supporting the moving member to be movable in the second direction, the base member including a gap in the first direction between the base member and the moving member, wherein the carriage locker includes an interspace in the first direction between the carriage locker and the carriage with the cap in the capping position, and wherein the gap in the first direction between the base member and the moving member is smaller than the interspace in the first direction between the carriage locker and the carriage with the cap in the capping position.

14. The liquid discharge apparatus according to claim 13, wherein the carriage includes a recess larger in size than the carriage locker, and wherein the carriage locker is inserted in the recess with the cap in the capping position.

15. The liquid discharge apparatus according to claim 13, wherein the base member includes a guide portion guiding the moving member in the second direction.

* * * * *